US006629690B1

(12) United States Patent
Viens

(10) Patent No.: US 6,629,690 B1
(45) Date of Patent: Oct. 7, 2003

(54) APPARATUS AND METHOD FOR CONVEYING A PRODUCT

(75) Inventor: Wilfred S. Viens, Lisbon, CT (US)

(73) Assignee: Gunther International, Ltd., Norwich, CT (US)

( * ) Notice: Subject to any disclaimer, the term of this patent is extended or adjusted under 35 U.S.C. 154(b) by 138 days.

(21) Appl. No.: 09/704,977

(22) Filed: Nov. 2, 2000

(51) Int. Cl.[7] ..... B65H 33/04
(52) U.S. Cl. ..... 270/58.01; 270/58.06
(58) Field of Search ..... 270/58.06, 58.01

(56) References Cited

U.S. PATENT DOCUMENTS

| | | | | |
|---|---|---|---|---|
| 1,880,112 | A | | 9/1932 | Shmyroff et al. |
| 3,090,481 | A | | 5/1963 | Biel et al. |
| 3,512,626 | A | | 5/1970 | Hovekamp |
| 3,842,965 | A | | 10/1974 | Pfaffle |
| 4,429,784 | A | | 2/1984 | Cromeens |
| 4,603,770 | A | | 8/1986 | Hartness |
| 4,801,036 | A | | 1/1989 | Rathert |
| 5,137,140 | A | | 8/1992 | Lecrone |
| 5,195,741 | A | * | 3/1993 | Stauber ..... 271/303 |
| 5,259,309 | A | * | 11/1993 | Stiel et al. ..... 101/232 |
| 5,282,614 | A | * | 2/1994 | Kalisiak et al. ..... 271/227 |
| 5,292,110 | A | * | 3/1994 | Honegger ..... 270/52.26 |
| 5,346,206 | A | * | 9/1994 | Steinhart ..... 271/305 |
| 5,415,386 | A | * | 5/1995 | Belec et al. ..... 270/58.27 |
| 5,515,668 | A | | 5/1996 | Hunt et al. |

* cited by examiner

*Primary Examiner*—Christopher P. Ellis
*Assistant Examiner*—Richard Ridley
(74) *Attorney, Agent, or Firm*—Ware, Fressola, Van der Sluys & Adolphson LLP

(57) ABSTRACT

An apparatus and method for high-speed conveying of product along a product conveying path and permitting products of different widths to be conveyed utilize six primary assemblies: outer rail assembly, inner rail assembly, pusher assembly, strap-ramp assembly, hold-down strap assembly and stop finger assembly. Insert feeders spaced above the conveyor system to feed inserts onto the conveyor system so as to be combined with the product as the product is conveyed along the product conveyor path. The insert feeders are pivotally mounted adjacent the product conveyor path to provide easy access to the product conveyor path for the operator.

148 Claims, 14 Drawing Sheets

102
104
106
108
110
112
114
116
118
120
122
124
125
126
128A
128B
128C
128D
130
132
134
136

APPARATUS AND METHOD FOR CONVEYING A PRODUCT

BACKGROUND OF THE INVENTION

1. Field of the Invention

The present invention relates to an apparatus and method for conveying products and, more particularly, to an apparatus and method for conveying documents in a high-speed electronic finishing system.

2. Description of the Prior Art

In the electronic finishing field, multi-page documents such as insurance policies and contracts are printed on high-speed laser printers and then finished on an electronic finishing system which assembles the document and adds any desired inserts (such as prefolded advertising brochures or other solicitations) to the document to create a product which are sometimes folded in manner set forth in U.S. Pat. No. 5,554,094. Then, the product is inserted into a standard envelope to create a package ready for mailing. These steps are done at high speed while the accuracy of the document assembly is verified through use of a printed bar code on each sheet of the document.

The prior art conveyors used to convey documents under the insert feeders are complicated and are difficult to adjust to accommodate different size documents. The prior art adjustable conveyors are inadequate because they often leave gaping holes in the conveyor path allowing products to sag or drop below the conveyor path.

Another problem with prior art conveyors is that the guiding rails are adjustable but the pusher path is fixed whereby, as the rails are adjusted wider for wider products, the pusher integrity become less stable. Thus, as the product gets wider in relation to the pusher path, the conveyor is the less reliable at advancing the product in a controlled manner.

Yet another shortcoming of the prior art conveyors is that the hold down devices are fixedly positioned such that they will prove adequate for the range of applications intended. However, when additional hold-down requirements arise, it often left up to the ingenuity of the operator or technician to solve the requirements.

Finally, all of the components which overhang the prior art conveyors make them difficult to access to clear jams and clean.

SUMMARY OF THE INVENTION

The present invention is designed to overcome the above limitations that are attendant upon the use of "prior art" devices, and toward this end, it contemplates the provision of a novel apparatus and method for the high-speed conveying of products and the provision of inserts to be combined with the products as they are conveyed.

It is an object of the present invention to provide an apparatus and method utilizing adjustable spring loaded collapsible pusher fingers to move the product though the conveying system.

Yet another object is to provide an apparatus and method which accomplish the desired provision of inserts at high speeds.

A further object is to provide an apparatus that is compatible with conventional electronic finishing systems and is generally compatible in physical size, form and configuration with such systems, to be readily adaptable for the same use without disadvantage.

It is a general aim of the invention to provide such an apparatus which may be readily and economically fabricated and will have long life in operation and significantly greater flexibility in use.

It has now been found that the foregoing and related objects can be readily attained in an apparatus and method in accordance with the present invention which conveys a product along a product conveying path, permits products of different widths to be conveyed and easily adds inserts as desired.

According to t he invention, a conveyor system for conveying the product along the product conveying path utilizes six primary assemblies: pusher assembly, inner rail assembly, outer rail assembly, strap-ramp assembly, hold-down strap assembly and stop finger assembly. Insert feeders are spaced above the conveyor system to feed inserts onto the conveyor system so as to be combined with the product as the product is conveyed a long the product conveyor path.

In the pusher assembly, there are a plurality of pusher devices. Each pusher device has a plurality of pushers for engaging at railing end of the product to propel the product along the product conveying path. At least two of the pushers on each pusher device are spaced from one another transversely across the conveying path and moveable between first and second positions transversely across the conveying path. These pushers are closer to one another in the first position than in the second position thereby being adjustable to convey products of different widths. A mechanism is provided for moving the pusher devices so that the pushers move along the product conveying path to propel the product engaged at the trailing end thereof along the product conveying path.

For the inner and outer rail assemblies, pairs of inner opposed rails support the product as it is propelled along the product conveying path. The inner opposed rails are adjustable between at least two distinct positions to permit conveying products of different widths. Pairs of outer opposed rails cooperate with the pairs of inner opposed rails for supporting the product as it is propelled along the product conveying path. The outer opposed rails being adjustable relative to and independent of the pair of inner opposed rails to permit conveying of products of different widths. Each of the outer opposed rails having a base portion for supporting the product as it is propelled along the product conveying path and an upstanding portion for guiding the product as it is propelled along the product conveying path.

With the strap-ramp assembly, a strap support device has a plurality of straps to support the product being propelled along the product conveying path. The straps are spaced from one another transversely across the product conveying path. At least some of the straps are moveable between first and second positions. In the first position, these straps are located to support the product being propelled along the product conveying path. In the second position, these straps are not located so as to support the product being propelled along the product conveying path. Desirably, a mechanism is provided for moving these straps of the strap support device between the first and second positions.

In the hold down assembly, at least one hold down support device extends over the product conveying path and at least one hold down strap is removeably mounted on the hold down support device. The hold down device holds the product flat on the conveyor path and helps decelerate the product at each indexing movement of the product.

To stop the product accurately at each station following each indexing movement of the product, the stop finger assembly includes a stop finger support device cantilevered over the product conveying path with at least one stop finger removeably mounted on the stop finger support device. The stop finger support device is moved so that the at least one stop finger moves into the product conveying path to engaged the product at a leading end thereof following each indexing movement of the product and moves out of the product conveying path to begin each indexing movement of the product.

To feed at least one insert onto the conveyor system so as to be combined with the product as the product is conveyed along the product conveyor path, a plurality of insert feeders are spaced above the conveyor system. Conveniently, each of the insert feeders is pivotally mounted adjacent the product conveyor path whereby the insert feeder can be rotated between an operative position spaced above the conveyor system for feeding at least one insert onto the conveyor system so as to be combined with the product as the product is conveyed along the product conveyor path and a raised inoperative position spaced farther from the product conveyor path to provide access to the product conveyor path.

The invention will be fully understood when reference is made to the following detailed description taken in conjunction with the accompanying drawings.

DETAILED DESCRIPTION OF THE INVENTION

Figure 1:
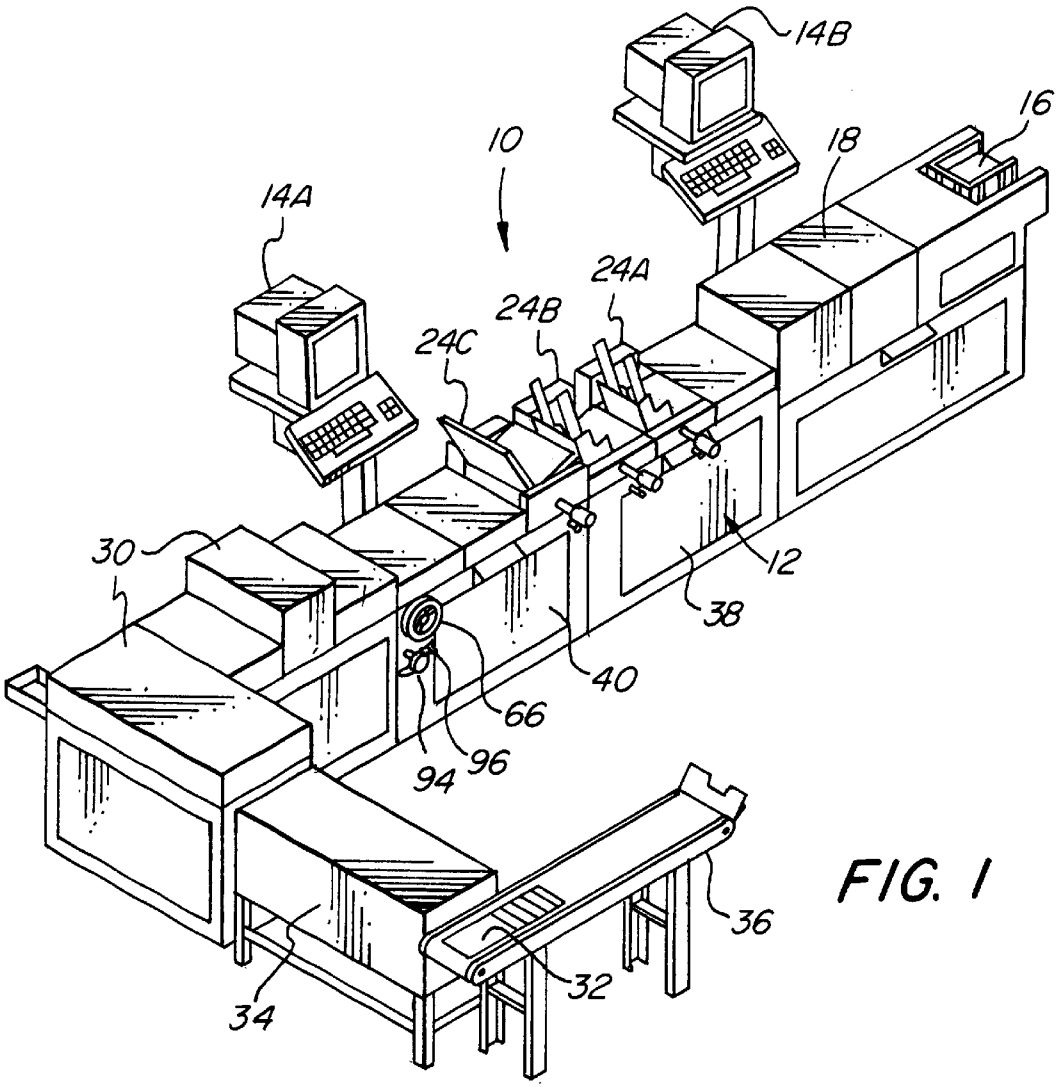
FIG. 1 is a perspective view of an electronic finishing system which utilizes an apparatus of the present invention for conveying a product along a product conveying path.

Turning first to FIG. 1 of the drawings, therein illustrated is an electronic finishing system generally designated by the numeral 10 which utilizes a high-speed adjustable conveyor system generally indicated by numeral 12 and made in accordance with the present invention. A computer processing unit (not shown) including two keyboard/monitor units 14A, 14B allows the user to track the operation of the electronic finishing system 10.

Figure 3:
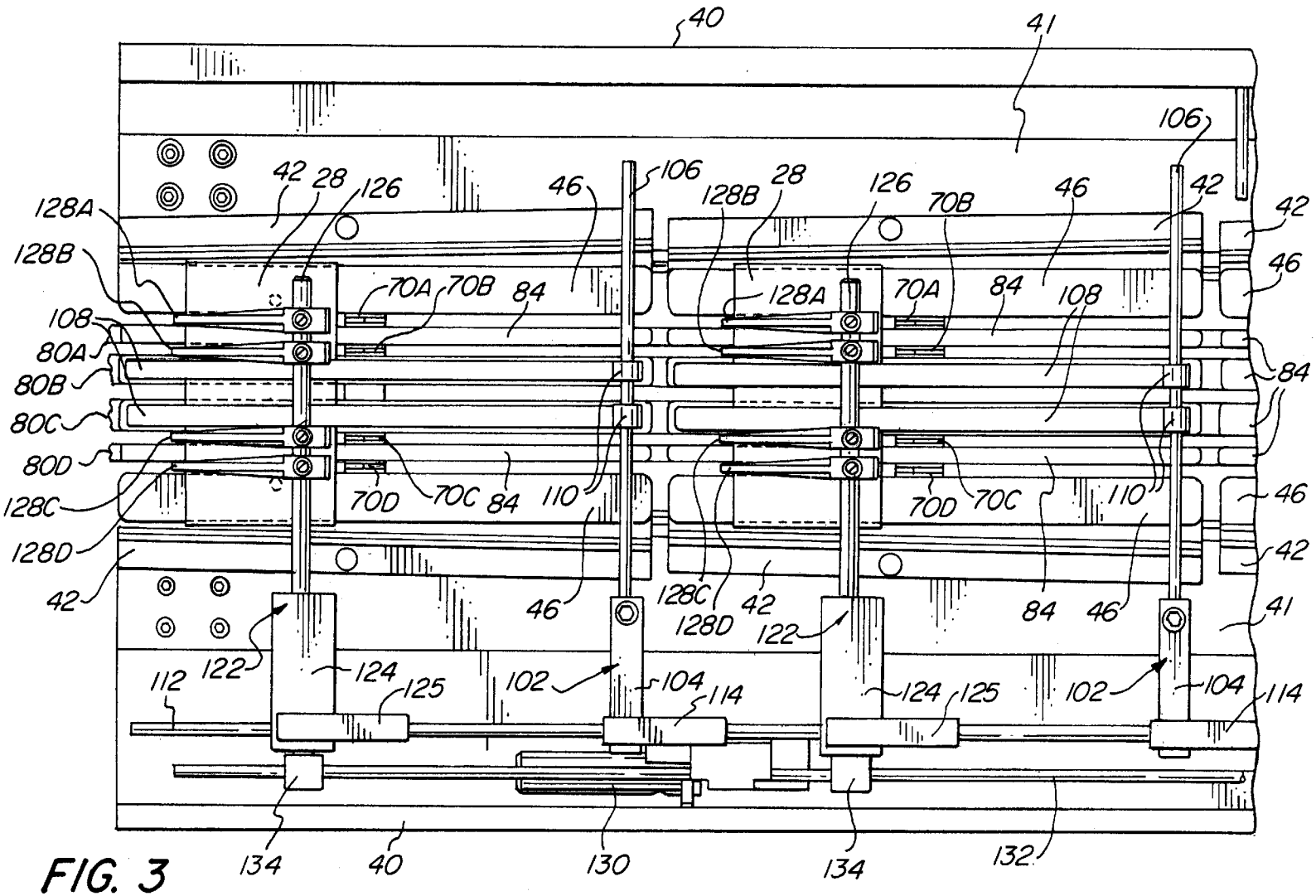
FIG. 3 is a top plan view of a portion of the apparatus of the present invention for conveying a product along a product conveying path.
Figure 4:
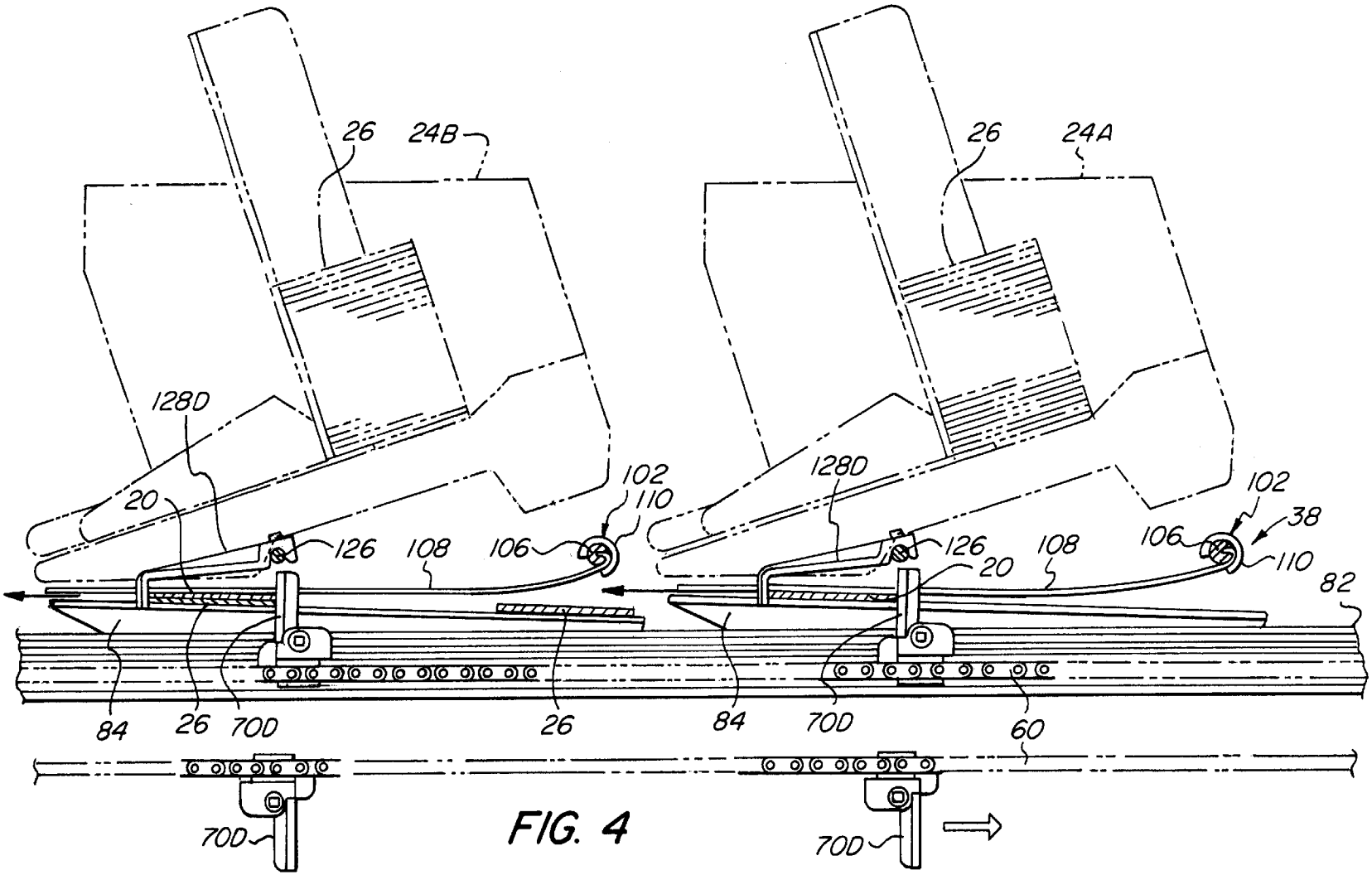
FIG. 4 is a schematic side elevational view of a portion of the apparatus of the present invention for conveying a product along a product conveying path.
Figure 5:
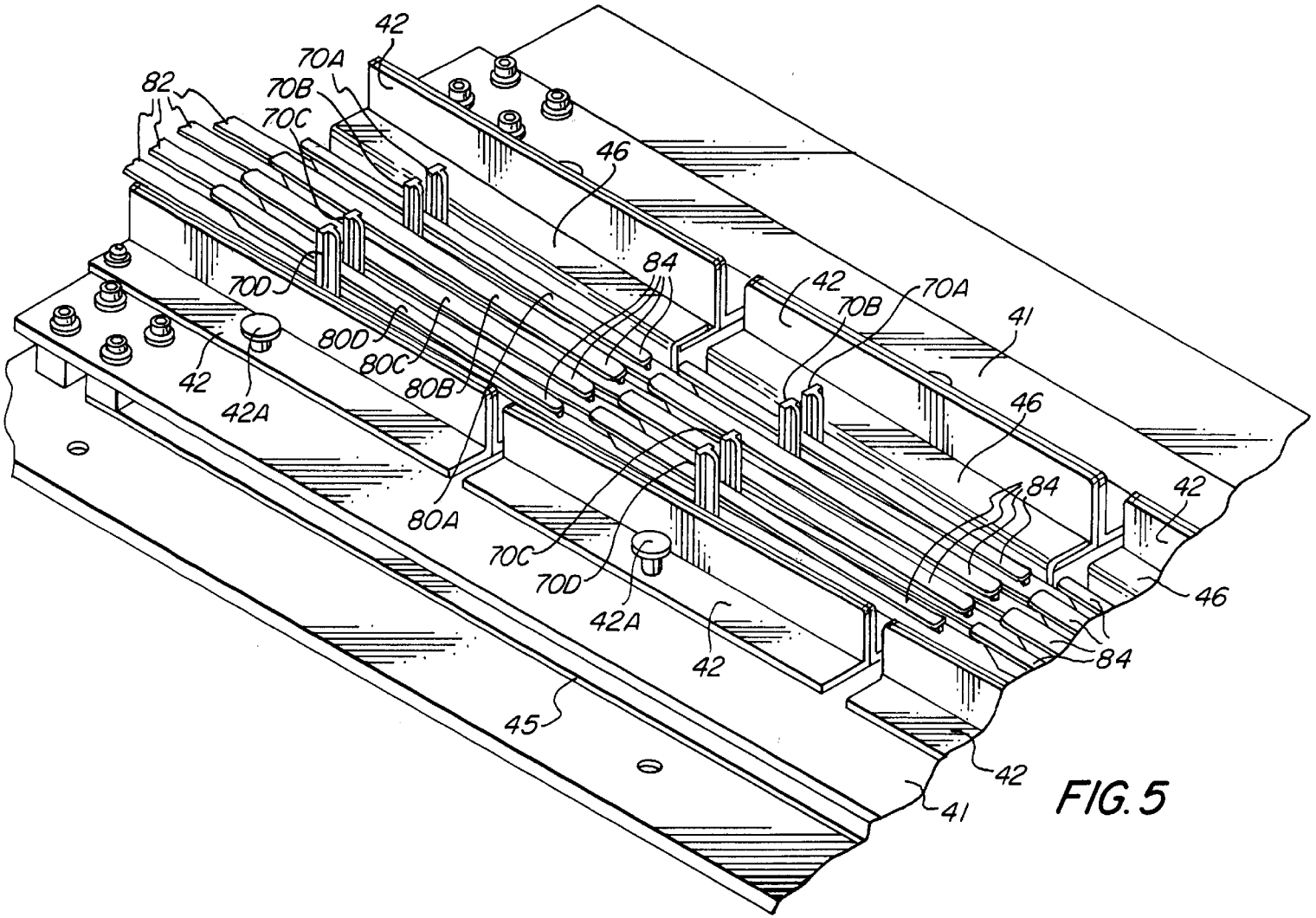
FIG. 5 is a perspective view of a portion of the apparatus of the present invention for conveying a product along a product conveying path with the hold-down strap assembly and stop finger assembly removed to reveal underlying structure.

Sheets of paper to be fed into the electronic finishing system 10 are placed into a primary document feeder 16. The document feeder 16 separates the sheets into individual stacks of sheets. For example, the stacks could be individual insurance policies. The stacks are sent through a folder 18 in which the stacks are folded in a manner shown by U.S. Pat. No. 5,554,094 to create a folded stack 20 (FIG. 4). Each sheet in each folded stack 20 of sheets has had a bar code printed thereon to verify the accuracy of its assembled stack 20. Bar code readers and sensors (not shown) are appropriately located throughout the electronic finishing system 10 so the computer processing unit can monitor each folded stack 20 of sheets as it proceeds through the electronic finishing system 10. As the folded stacks 20 exit from the folder 18, they are transferred onto the high-speed adjustable conveyor system 12. The folded stacks 20 are then transferred by the high-speed adjustable conveyor system 12 past a plurality of insert feeders 24A, 24B, 24C spaced above the high-speed adjustable conveyor system 12 for combining inserts 26 (FIGS. 2 and 4) with the folded stacks 20 to create products 28 (FIG. 3). The computer processing unit controls the operation of the insert feeders 24A, 24B, 24C and signals them to feed the appropriate insert(s) 26 (FIGS. 2 and 4) in accordance with the specific needs of folded stacks 20 passing underneath based on the bar codes thereon. Thereafter, the products 28 continue along the high-speed adjustable conveyor system 12 and are inserted into window or close faced envelopes at an enveloper 30 such as that described in U.S. Pat. No. 5,950,399 to create packages 32. Each package 32 is introduced to a module 34 for applying the proper postage and/or addresses (if necessary for closed faced envelopes) on the packages 32. The packages 32 with postage and addresses proceed onto a slowly indexed conveyor 36 where the packages 32 are aligned in a shingled manner ready to be mailed.

Turning now to FIGS. 2–5 of the drawings, the high-speed adjustable conveyor system 12 has two modules 38, 40 and may have additional modules depending on the number of insert feeders desired. The module 38 has up to two insert feeders 24A, 24B thereon while the module 40 has one insert feeder 24C thereon but can be provided with an additional insert feeder if desired. Additional modules may each have up to three insert feeders. The high-speed adjustable conveyor system 12 is comprised of six primary assemblies: outer rail assembly, inner rail assembly, pusher assembly, strap-ramp assembly, hold-down strap assembly and stop finger assembly.

Each module 38, 40 has an outer rail assembly with moveable opposed outer rail supports 41 having three pairs of adjustably secured, opposed upstanding L-shaped outer rails 42 extending along and defining the longitudinal conveying path of the high-speed adjustable conveyor system 12. The outer rail supports 41 are each connected to a separate rack in a rack and pinion system 43 (FIG. 15) which allows the operator to move the outer rail supports 41 and the outer rails 42 thereon simultaneously in a perpendicular direction to the longitudinal conveying path of the module. A release knob 44 (FIG. 2) centrally located on the front face of each module 38, 40 is used by the operator to release a brake (not shown) on the rack and pinion system 43 so the outer rail supports 41 and the outer rails 42 can be so moved. The outer rail supports 41 ride on ball bearings (not shown) and linear ball slides (not shown) to facilitate such movement. After the desired position of the outer rails 42 is achieved, the operator then releases the knob 44 locking the opposed outer rails 42 in position.

An additional feature designed into the outer rail assembly is product centering at each station. Conventional conveyor systems are typically adjusted quite wide for the majority of the longitudinal conveyor path thereby facilitating the feeding of inserts required to complete the product. Then, near the end of the conveyor, some of the rails are tapered in, to center the product and neaten the stack for insertion into the envelope. In some cases, this practice can be quite problematic as it attempts to neaten a poorly stacked product all in one motion. To address this problem, the present invention has each pair of outer rails 42 taper back toward the longitudinal conveyor path at each station or every 17½ inches thereby neatening the stack as each insert is added. The taper can be adjusted by use of a screw 42A (FIG. 5) on each outer rail 42. This ensures, regardless of the complexity of the product being assembled, optimum control and stack neatness through out the assembly process.

Each module 38, 40 has an inner rail assembly with moveably opposed inner rail supports 45 (FIGS. 5 and 15) having three pairs of opposed inner rails 46 which extend along the longitudinal conveying path of the high-speed adjustable conveyor system 12 with each inner rail 46 nested or telescoped with a respective one of the opposed outer rails 42. The inner rails 46 are adjustable to one of three detented positions: narrow, medium or wide. Spring loaded detents (not shown) mounted in the module engage the opposed inner rail supports 45 to retain them in one of the three detented positions. In a manner similar to the outer rail assembly, the opposed inner rail supports 45 with the opposed inner rails 46 thereon when forced by hand either closer together, or further apart, are mechanically connected by a rack and pinion system 47 (FIG. 15) so that they all move symmetrically and perpendicularly to the longitudinal centerline of the conveyor path. The opposed inner rail supports 45 also ride on ball bearing guides (not shown) to facilitate the movement thereof. Further, the opposed inner rails 46 are automatically detented by the spring loaded detents into the next width mode when they approach the correct position. It should be noted that the inner and outer rail assemblies interact with each other as the outer rails 42 telescope or nest within the inner rails 46.

As will be appreciated by those skilled in the art, the inner rail assembly also features a pair of optical sensors (e.g. well-known reflective sensors not shown) per station, i.e. one on each inner rail. These sensors are wired in series, requiring that both sensors be covered to constitute a successful index. This permits the computer processing unit (not shown) to verify not only that the product was moved successfully from one station to the next, but that the product was moved in a manner parallel to the longitudinal conveyor path of the high-speed adjustable conveyor system 12. Also, it should be noted that since these sensors are mounted to the inner rail assembly, the optimum position for the sensors is achieved automatically when width adjustments are made for products.

Figure 6:
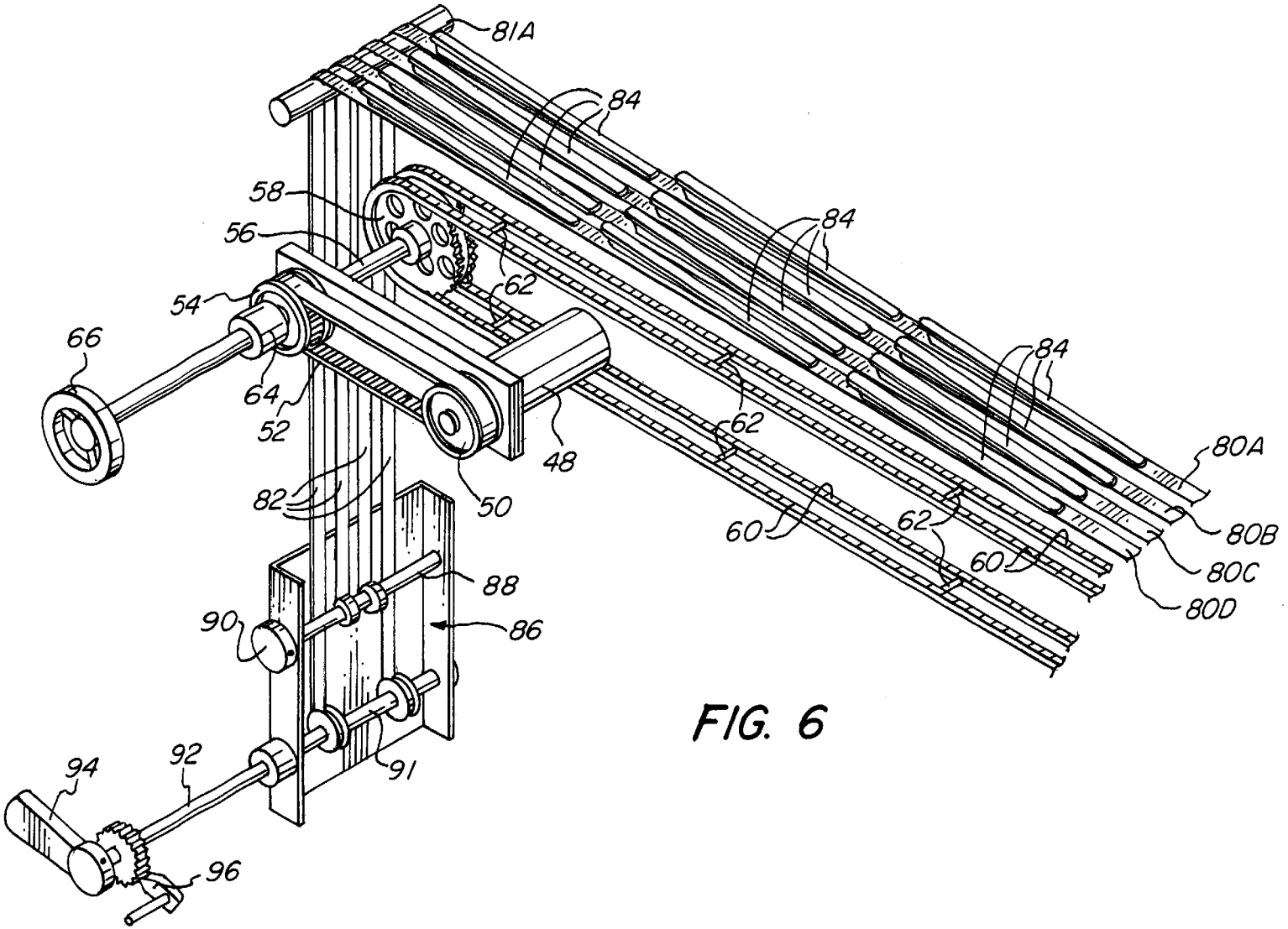
FIG. 6 is a schematic perspective view of portions of the pusher assembly and strap-ramp assembly of the present invention.
Figure 7:
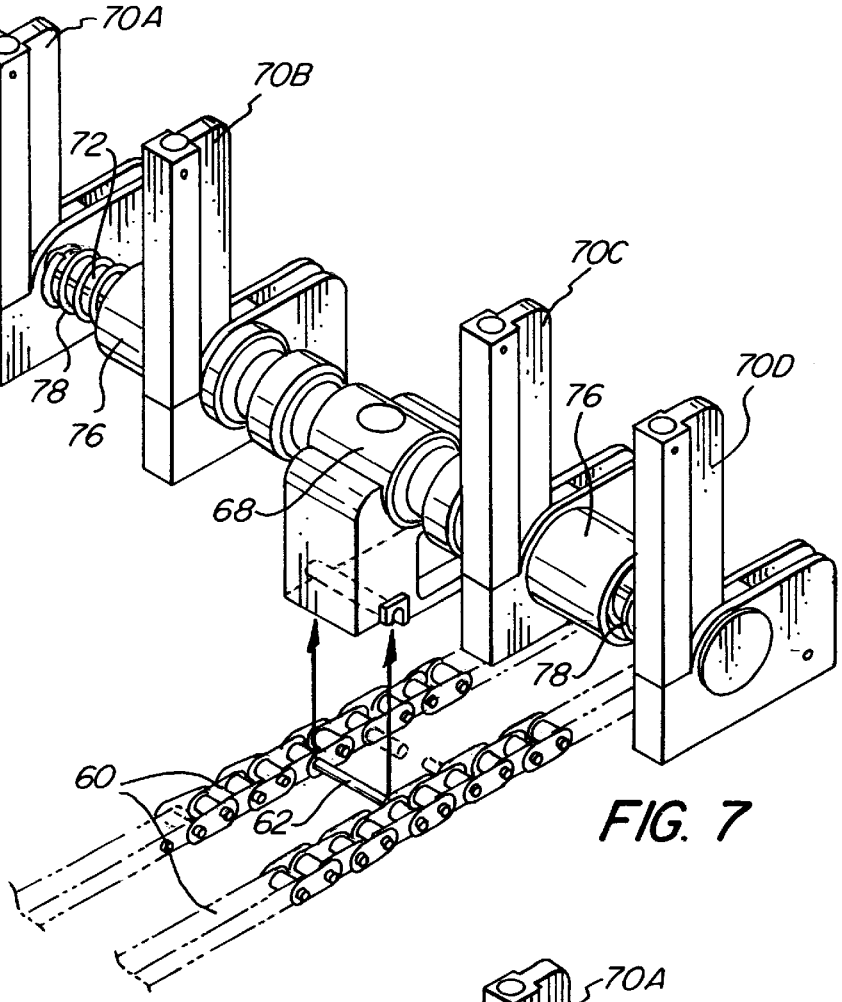
FIG. 7 is an exploded perspective view of a portion of the pusher assembly.
Figure 9:
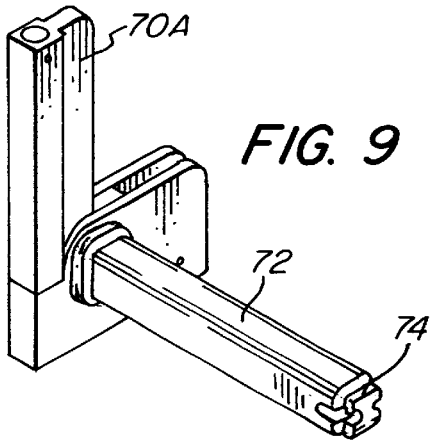
FIG. 9 is a perspective view of one of the outer spring loaded collapsible fingers.
Figure 8:
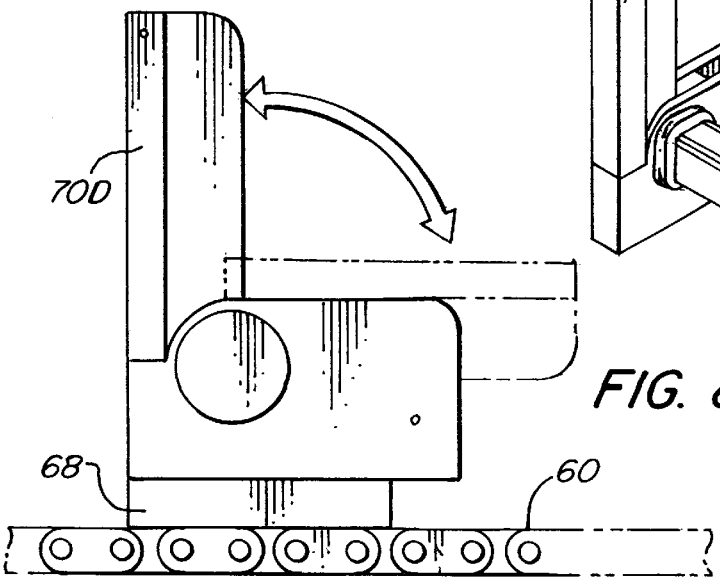
FIG. 8 is a side elevational view of a portion of the pusher assembly and illustrating the collapsing feature of one of the spring loaded collapsible fingers.

Referring to FIG. 6, the pusher assembly has a chain drive system mounted in the modules 38, 40 below the longitudinal conveyor path. In the left side of the module 40, the chain drive system has an indexing servo-motor 48 having a pulley 50 thereon for driving a toothed belt 52 which in turn drives an idler pulley 54. One end of a shaft 56 is fixed to the pulley 54 while the other end is fixed to a dual sprocket wheel 58 which drives an endless ¼ pitch dual pusher chain 60 which is connected every 8¾ inches by pins 62. The pusher chain 60 extends under the longitudinal conveyor path into the module 38 where it goes around dual sprocket idler wheel 58 (FIG. 2) at the right side of the module 38. Adjacent the idler pulley 54, the shaft 56 is provided with a clutch 64 operationally connected to a manual cycle wheel 66 which permits the operator to manually rotate shaft 56 and thus dual sprocket wheel 58 and pusher chain 60 for purposes to be explained further hereinafter.

Figure 10:
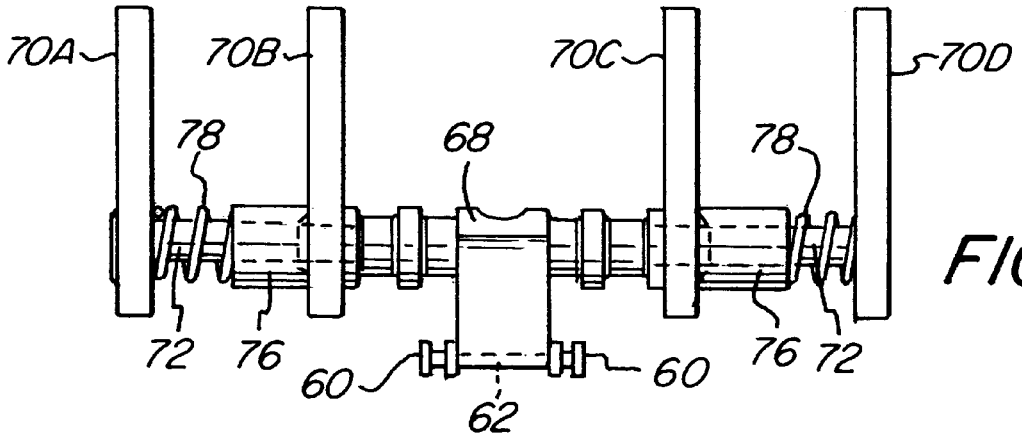
FIG. 10 is front elevational view of a pusher housing with the outer spring loaded collapsible fingers in their wide mode position.
Figure 11:
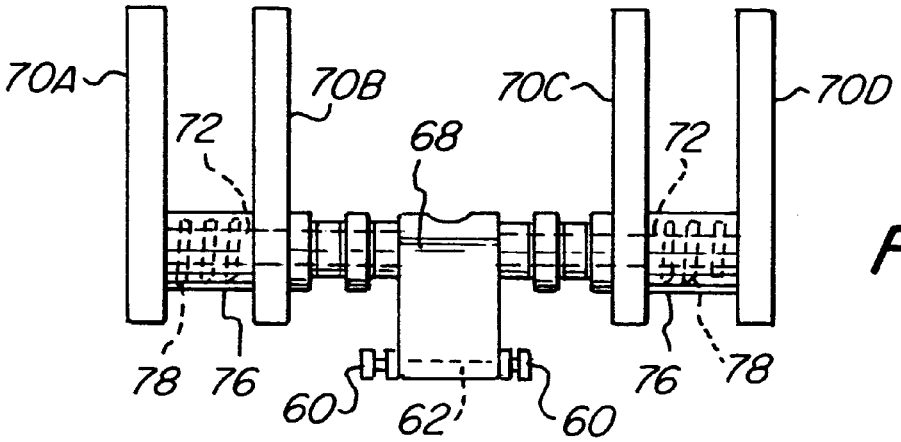
FIG. 11 is front elevational view of-a pusher housing with the outer spring loaded collapsible fingers in their medium mode position.
Figure 12:
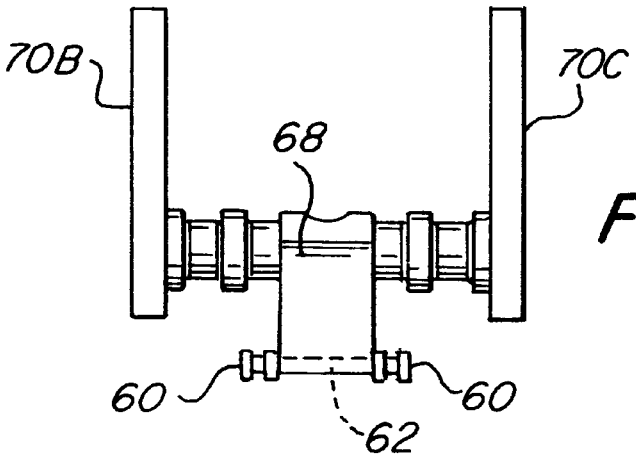
FIG. 12 is front elevational view of a pusher housing with the outer spring loaded collapsible fingers removed for the narrow mode position.

Referring to FIGS. 7–12, attached every 17½ inches to the pusher chain 60 at every other pin 62 is a pusher housing 68 to which four fingers 70A, 70B, 70C, 70D are connected. The four fingers 70A, 70B, 70C, 70D are spring loaded and collapsible as illustrated by the arrow in FIG. 8. The pusher housing 68 extends transversely across the pusher chain 60 and has the two inner spring loaded collapsible fingers 70B, 70C positioned at the end thereof. The two outer spring loaded collapsible fingers 70A, 70D each have a square shaft 72 (FIG. 9) extending at right angles therefrom for insertion through the spring loaded collapsible fingers 70B, 70C into the pusher housing 68 thereby permitting the spring loaded collapsible fingers 70A, 70D to be cantilevered from the pusher housing 68. Each shaft 72 has a specially shaped end 74 which interacts with two corresponding cutouts (not shown) within the pusher housing 68 allowing the spring loaded collapsible fingers 70A, 70D to be temporarily secured in either their medium mode (FIG. 11) and wide mode (FIG. 10) for purposes to be explained further hereinafter. A spacer 76 and spring 78 surround the shaft 72 to properly support the strap-ramp assembly. The spring 78 maintains the spacer 76 in the proper position to support the strap-ramp assembly. The outer spring loaded collapsible fingers 70A, 70D and their associated spacers 76 and springs 78 can also be completely removed from the pusher housing 68 as seen in FIG. 12 when the high-speed adjustable conveyor system 12 is being used in its narrow mode.

Figure 13:
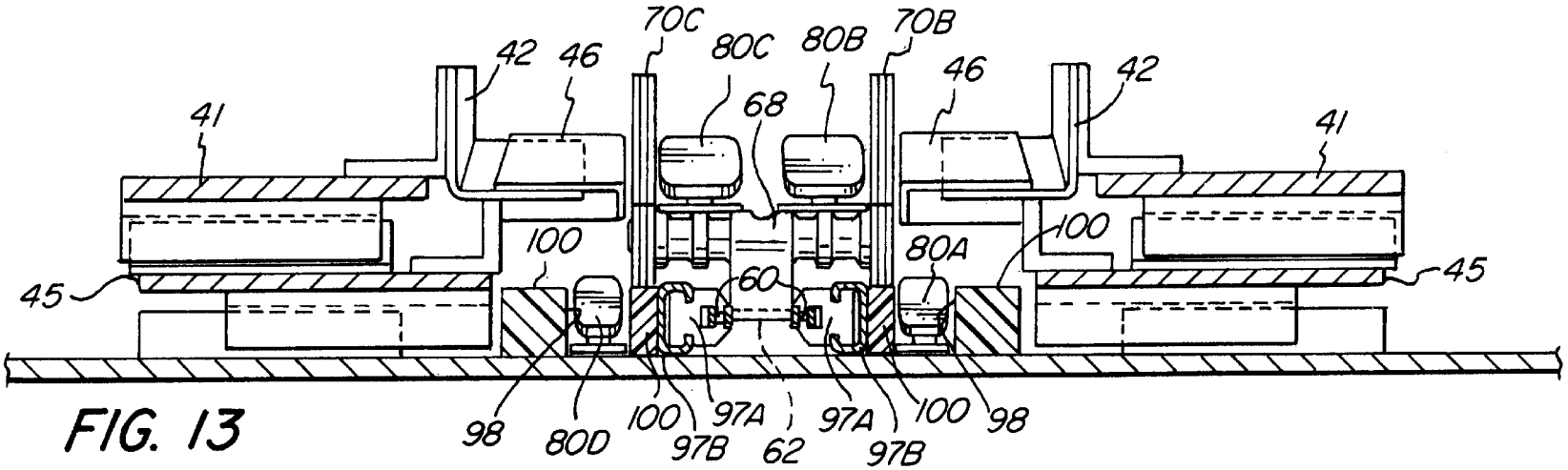
FIG. 13 is a cross-sectional view of the apparatus of the present invention for conveying a product set for its narrow mode of operation.
Figure 14:
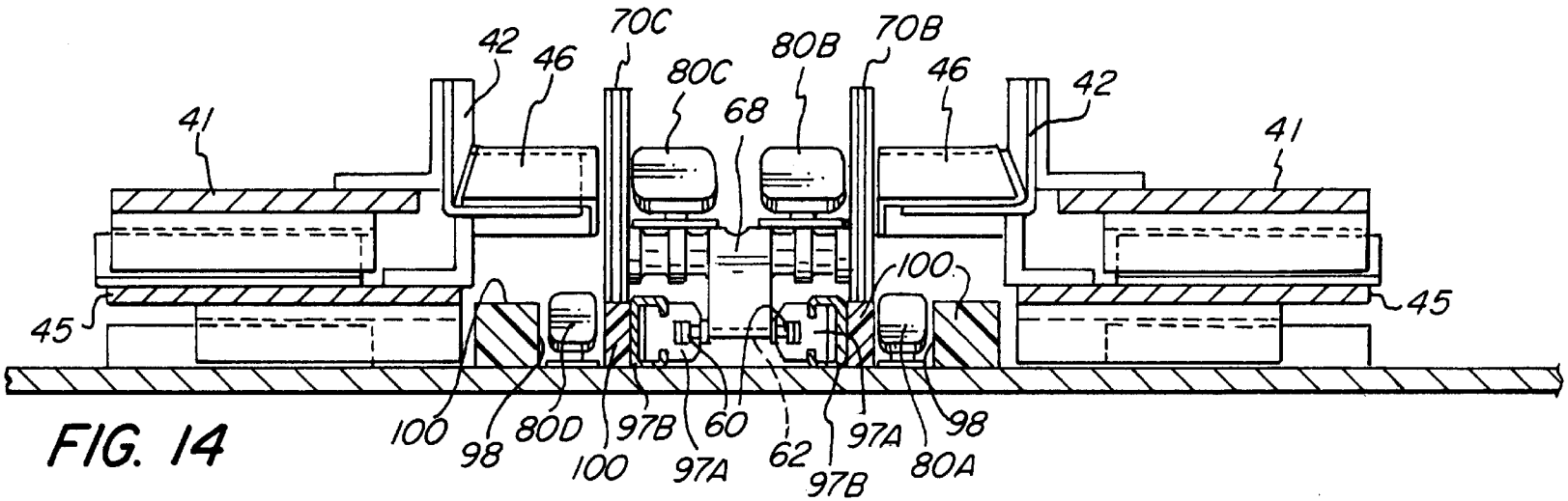
FIG. 14 is a cross-sectional view of the apparatus of the present invention for conveying a product set for its narrow mode of operation but with the outer rails set at their inner most position.
Figure 15:
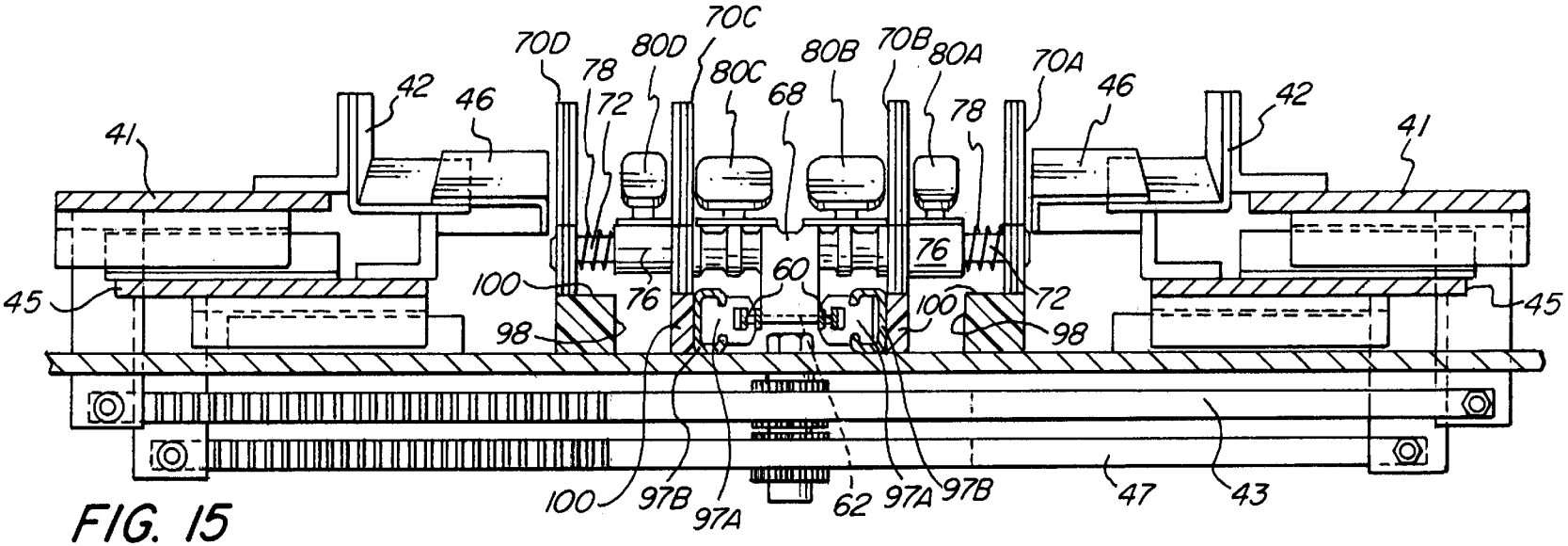
FIG. 15 is a cross-sectional view of the apparatus of the present invention for conveying a product set at its wide mode of operation and also illustrating both of the rack and pinion systems for controlling the inner and outer rail assemblies.
Figure 16:
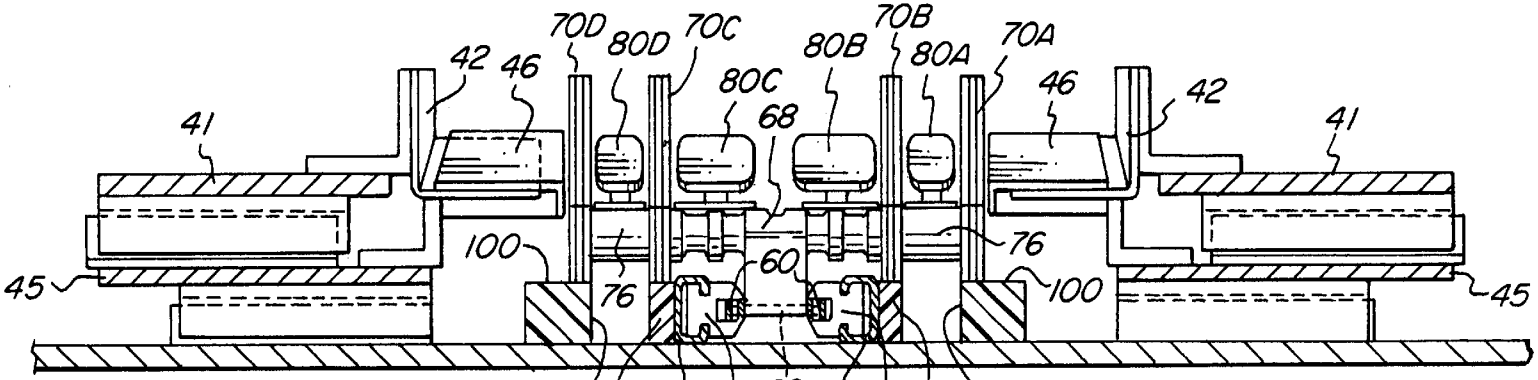
FIG. 16 is a cross-sectional view of the apparatus of the present invention for conveying a product set at its medium mode of operation.

Referring again to FIG. 6, the strap-ramp assembly has four sets of strap-ramps 80A, 80B, 80C, 80D that extend down the longitudinal conveyor path of the high-speed adjustable conveyor system 12 from a shaft 81A (FIG. 2) and over a shaft 81B (FIG. 6). The strap-ramps 80A, 80B, 80C, 80D are provided with flexible straps 82 upon which wedge-shaped plastic ramps 84 are secured in position to correspond in profile and position with the inner and outer rails 42, 46. The top surfaces of the ramps 84 are upwardly sloped at a two degree incline. The function of the strap-ramps 80A, 80B, 80C, 80D is to support the product across the full width of the longitudinal conveyor path while providing clearance for the four spring loaded collapsible fingers 70A, 70B, 70C, 70D (see FIG. 3). To allow the pusher housings 68 to pass under these strap-ramps 80A, 80B, 80C, 80D, the straps 82 of the strap-ramps 80A, 80B, 80C, 80D are stretched tight by a tensioning mechanism generally referenced by the numeral 86 to the suspended strap-ramps 80A, 80B, 80C, 80D just above the path of the pusher housings 68 from one end of the adjustable conveyor system 12 to the other. As seen in FIGS. 15 and 16, the spacers 76 and the pusher housing 68 passing underneath the strap-ramps 80A, 80B, 80C, 80D provide support thereto. The inner strap-ramps 80B, 80C are always under tension by being wrapped around shaft 88. The exact amount of tension on strap-ramps 80B, 80C can be adjusted by the operator by means of an adjustment mechanism 90. The straps are wrapped around a shaft 91. The tension on the straps 82 of the outer strap-ramps 80A, 80D is also adjustable by use of an adjustment mechanism 92 having a handle 94 and locking mechanism 96 extending out of the front of the module 40. As will be explained further hereinafter, once the tension is released the outer strap-ramps 80A, 80D, they can be stowed below the longitudinal conveyor path as shown in FIGS. 13–14.

As will be appreciated by those skilled in the art when referring to FIG. 13–16, the high-speed adjustable conveyor system 12 can be adjusted from 6¼ inches wide to 11½ inches. The high-speed adjustable conveyor system 12 operates in three basic modes: narrow width, medium width and wide width. When set in the narrow mode of operation shown in FIGS. 13–14, the outer and inner rails 42, 46 of the high-speed adjustable conveyor system 12 readily adjust from 6¼ inches wide to 8½ inches wide. If set to the medium mode shown in FIG. 15, the outer and inner rails 42, 46 of the high-speed adjustable conveyor system 12 readily adjusts from 8¼ inches wide to 10½ inches wide. Finally, if set for wide mode shown in FIG. 15, the outer and inner rails 42, 46 of the high-speed adjustable conveyor system 12 readily range from 9¼ inches wide to 11½ inches wide. In any of the three modes of operation, mentioned above, the outer rails 42 of the high-speed adjustable conveyor system 12 may be adjusted by the operator to any width, within the range set by the position of the inner rails 46, in just seconds.

Before positioning the outer and inner rails 42, 46 for the desired mode of operation, the operator of the electronic finishing system 10 must make sure the outer spring loaded collapsible fingers 70A, 70D are properly positioned. The spring loaded collapsible fingers 70A, 70D telescope in and out of the spring loaded collapsible fingers 70B, 70C thereby maintaining the proper pusher path to product width ratio. Like the inner rails 46, the outer spring loaded collapsible fingers 70A, 70D have three modes of operation: narrow, medium and wide. The adjustment of mode of operation of the spring loaded collapsible fingers 70A, 70D has to be made to each assembly of spring loaded collapsible fingers 70A, 70B, 70C, 70D along the pusher chain 60 but the adjustment is very simple and fool-proof. The adjustment of the mode of operation of the spring loaded collapsible fingers 70A, 70D is accomplished by first moving all of the outer and inner rails 42, 46 to their full outward positions. The operator then manually advances each assembly of the spring loaded collapsible fingers 70A, 70B, 70C, 70D to the left end of the module 40 using the manual cycle wheel 66 on the face of the module 40. As seen in FIGS. 13–16, the pusher chain 60 is guided along underneath the longitudinal conveyor path by opposed plastic guides 97A held by C-shaped metal retainers 97B. When each assembly of the spring loaded collapsible fingers 70A, 70B, 70C, 70D is positioned at the left end of the module 40 by the manual cycle wheel 66, the operator snaps the outer spring loaded collapsible fingers 70A, 70D to the desired position. The outer spring loaded collapsible fingers 70A, 70D may be positioned in any one of the narrow, medium or wide modes. As shown in FIG. 10, for the wide mode of operation, the outer spring loaded collapsible fingers 70A, 70D are snapped to the full out position. For medium width mode, the outer spring loaded collapsible fingers 70A, 70D are simply snapped to their full inward position as shown in FIG. 11 with the spring 78 recessed within the spacer 76. For the narrow mode of operation shown in FIG. 12, the outer spring loaded collapsible fingers 70A, 70D are simply removed leaving only the inner spring loaded collapsible fingers 70B, 70C for the narrow mode.

Once the desired position of the outer spring loaded collapsible fingers 70A, 70D is achieved, the inner rails 46 can be positioned simply by having the operator grasp and move the inner rails 46 to one of three predetermined positions: narrow, medium or wide. The inner rail supports 45 (with the inner rails 46 thereon) move simultaneously and symmetrically via the rack and pinion system 47 and automatically detent into the narrow, medium or wide width mode when they approach the correct position. If the operator is adjusting the high-speed adjustable conveyor system 12 to the narrow mode having removed the outer spring loaded collapsible fingers 70A, 70D, one additional step is necessary before adjusting the inner rails 46. Like the outer spring loaded collapsible fingers 70A, 70D, the outer strap-ramps 80A, 80D, for narrow mode, are not only unnecessary, but they are in the way and prevent the inner rails 46 from closing down to accommodate narrow products in the narrow mode. To retract the outer strap-ramps 80A, 80D, the tension on the straps 82 of the outer strap-ramps 80A, 80D must be released by use of the handle 94 of the adjustment mechanism 92 after the locking mechanism 96 is released (FIG. 6). Once the tension is released, the outer strap-ramps 80A, 80D are easily tucked into cavities 98 (FIGS. 13–14) provided between the skids 100 upon which the spring loaded collapsible fingers 70A, 70B, 70C, 70D ride leaving the outer strap-ramps 80A, 80D below the longitudinal conveyor path. Thereafter, the inner rails 46 can be positioned to their narrow mode detented position.

Once the inner rails 46 are positioned for the mode of operation desired, the outer rails 42 may be adjusted on each module 38, 40. This is accomplished simply by placing the widest product to be handled by the high-speed adjustable conveyor system 12 at the end of a flight or station on the module being adjusted. The operator then pulls the release knob 44 centrally located on the face of the module 38, 40, moves the outer rails 42 to accommodate the product width, and then releases the knob 44, locking the rails 42 in position. This procedure must be repeated for each module 38, 40. As with the inner rails 46, all of the outer rails 42 simultaneously move symmetrically about the longitudinal conveyor path as they are connected to each other through the outer rail supports 41 and the rack and pinion system 43. The outer and inner rails 42, 46 interact with each other as the outer rails 42 telescope or nest within the inner rails 46. This feature ensures optimum product support and is contradictory to traditional conveyors which when adjusted to a wide mode leave gaping holes in the longitudinal conveyor path allowing products to sag or drop below the longitudinal conveyor path.

Figures 17, 18, 19:
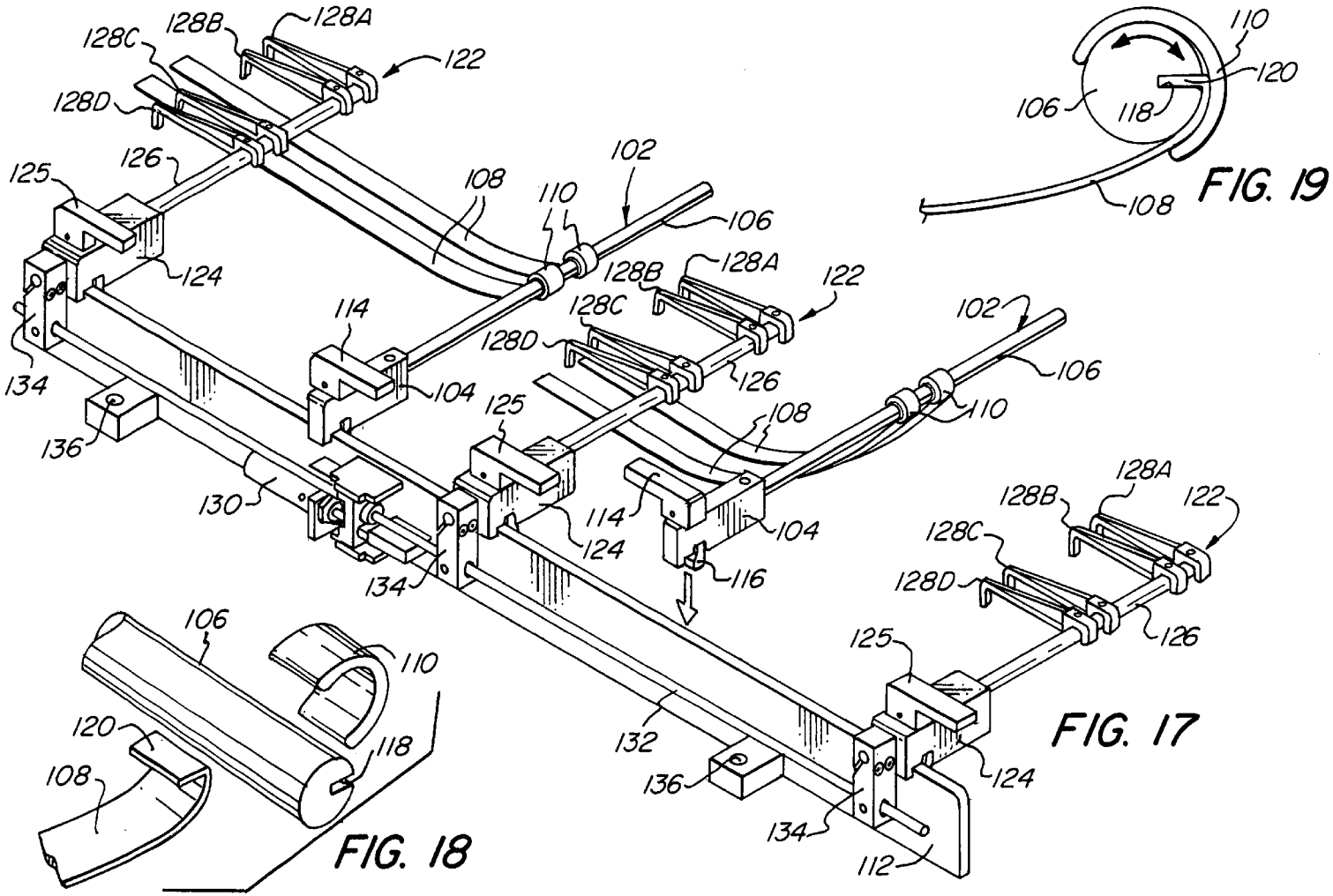
FIG. 17 is a perspective view of a portion of the hold-down strap assembly and the stop finger assembly.
FIG. 18 is an exploded perspective view of a portion of the hold-down strap assembly.
FIG. 19 is an end elevational view of the portion of the hold-down strap assembly of FIG. 18.

Referring now to FIGS. 17–19, therein is illustrated the hold-down strap assemblies of the present invention which are generally indicated by the numeral 102. Typically, one of these hold-down assemblies 102 is positioned at each station of the high-speed adjustable conveyor system 12. The function of the hold down strap assemblies 102 is to hold the products flat on the conveyor path and to help decelerate the products at the end of each indexing movement of the products. Since there is a wide range of product widths and thicknesses and a wide variety of sizes, thickness and quantities of inserts 26 to be added by the insert feeders 24A, 24B, 24C, the hold-down strap requirements often change from job to job. Typically, conventional conveyors attempt to position hold down devices such that they will prove adequate for the range of applications intended but, if additional hold-down requirements arise, these traditional systems are not flexible enough to accommodate the additional requirements. The hold-down strap assemblies 102 of the present invention offer infinite flexibility by adapting to any requirement quickly and easily.

As shown in FIG. 17, each assembly 102 includes a clamp block 104, a strap-mounting shaft 106 extending from the clamp block 104, an array of hold-down straps 108 which can varying in length and thickness and a strap retainer clip 110 for each hold-down strap 108. The clamp blocks 104 clamp to a rail 112 which runs parallel to the longitudinal conveyor path on each of the modules 38, 40. A manually released lever 114 is turned one hundred eighty degrees (180°) to control a clamp 116 so the assembly 102 can be positioned easily, wherever needed, along the longitudinal conveyor path.

In FIGS. 18–19, it can be seen that the strap-mounting shaft 106 has a narrow slot 118 machined along the length thereof into which the end 120 of the hold-down strap 108 is releasably inserted. The strap retainer clip 110 resiliently snap fits over the strap-mounting shaft 106 to retain the hold-down strap 108 so that the hold-down strap 108 can be very quickly and easily added, removed or repositioned in the desired position across the strap-mounting shaft 106 as required. The strap-mounting shaft 106 spans the full useable width of the high-speed adjustable conveyor system 12 allowing the hold-down straps 108 to be positioned anywhere thereacross.

Although the hold-down strap assemblies 102 do assist in decelerating and maintaining the neatness of the product stack, the hold-down strap assemblies 102 do not guarantee stoppage of the product at the end of each indexing movement of the product. Such stoppage is the function of the stop finger assemblies 122 also shown in FIG. 17. The stop finger assemblies 122, like the hold-down strap assemblies 102, use a clamp block 124 with a manually released lever 125 and clamp (not shown) to retain the stop finger assemblies 122 on the rail 112 of each module 38, 40. As with the hold-down strap assemblies 102, there is one stop finger assembly 122 per station. Each stop finger assembly 122 employs a shaft 126 rotatably cantilevered in the clamp block 124 and having four stop fingers 128A, 128B, 128C, 128D removeably mounted thereon in alignment with the spring loaded collapsible fingers 70A, 70B, 70C, 70D as seen in FIG. 3. When the high-speed adjustable conveyor system 12 is being set for its narrow mode of operation, outer stop fingers 128A, 128D are removed from the shaft 126. On each module 38, 40, the shafts 126 of all of the stop finger assemblies 122 are rotated by a piston-cylinder arrangement 130 which is connected to a drive shaft 132 that runs the length of the module 38, 40. The driveshaft 126 actuates the three stop finger assemblies 122 by being connected to a drive block 134 on the end of each shaft 126. When actuated, the stop fingers 128A, 128B, 128C, 128D (or only stop fingers 128B, 128C if set for the narrow mode of operation) are moveable into the longitudinal conveyor path as shown in FIGS. 3–4 to stop the movement of the products so they are properly indexed at each station.

All of these actuating components shown in FIG. 17 reside on the rail 112 at the front of the modules 38, 40 which permits them to be removed and reinstalled therefrom in just seconds. This is accomplished simply by loosening two clamp-tensioning screws 136, which attach the rail 112 to the module 38 or 40 and disconnecting two pressurized air line quick disconnects (not shown) to the piston-cylinder arrangement 130. The rail 112, the three stop finger assemblies 122, the stop finger actuating components and all of the hold-down strap assemblies 102 for that module, can them be simply lifted off the high-speed adjustable conveyor system 12. This special feature greatly enhances accessibility for general maintenance and cleaning.

Figure 2:
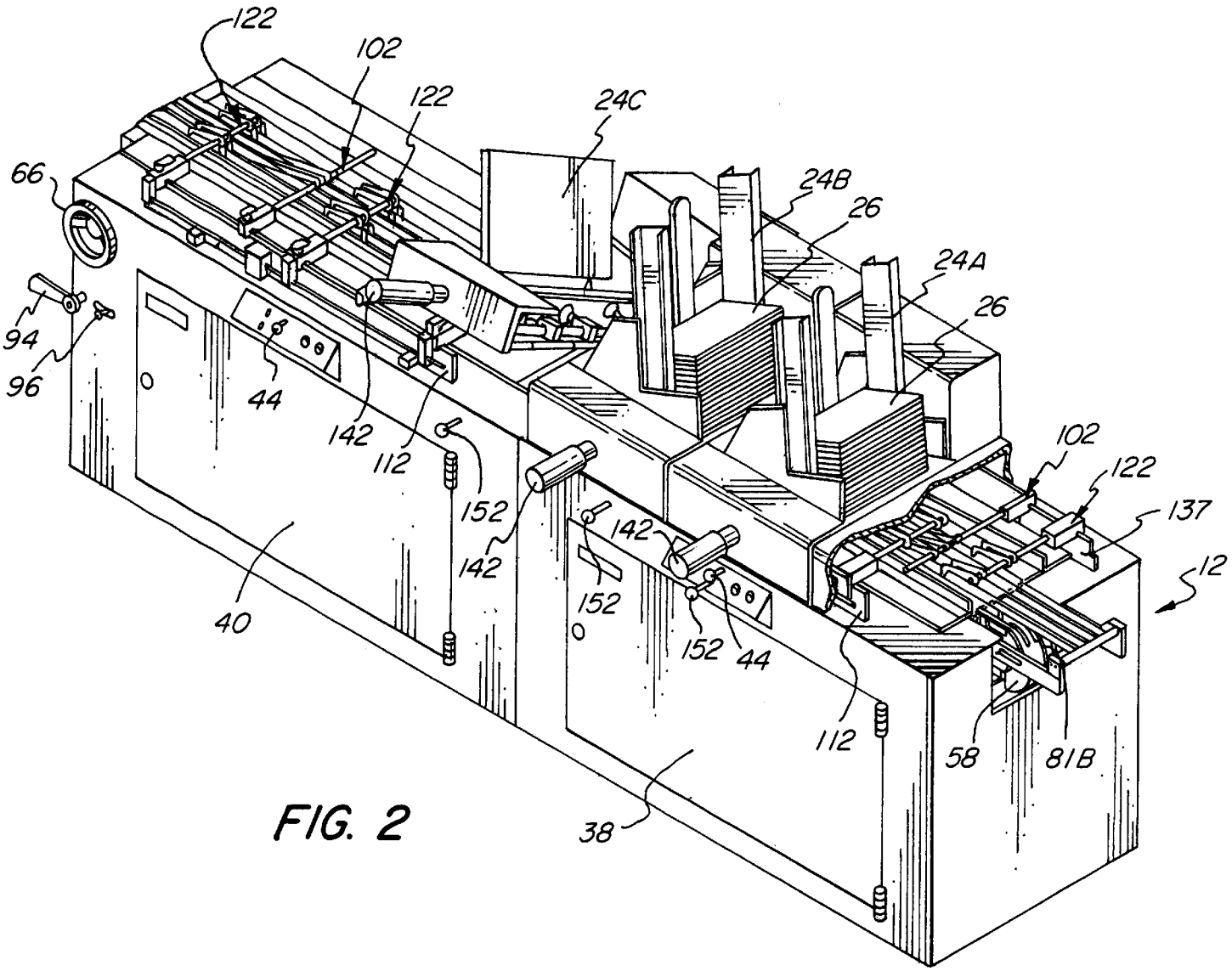
FIG. 2 is a perspective view of the apparatus of the present invention for conveying a product along a product conveying path with portions of the housing for one of the insert feeders broken away to reveal underlying structure.

On the right side of FIG. 2, it should noted that a staging station is located at an entry end of the module 38. This staging station has a hold-down strap assembly 102 and a stop finger assembly 122 mounted on a rail 137 on the back side of the module 38. The stop finger assembly 122 in the staging station is driven similarly to the previously discussed stop finger assembly 122 in the adjustable conveyor system 12 by a separate piston-cylinder arrangement (not shown) mounted along the back side of the module 38 and uses a different timing sequence so folded stacks of sheets 20 coming from the folder 18 can be properly staged and delivered to the remainder of the adjustable conveyor system 12.

It should be appreciated by those skilled in the art that the relationship between the position of the stop fingers 128A, 128B, 128C, 128D and the stopping place or home position of the spring loaded collapsible fingers 70A, 70B, 70C, 70D is directly proportional to the length of the documents being handled by the electronic finishing system 10. This relationship is important in order to maintain a neatly stacked product as inserts 26 are added, and to ensure the documents continue to index straight down the longitudinal conveyor path. For this reason, it is important that this relationship be changed to accommodate various document lengths. In the past, this was accomplished by physically changing the position of the stop finger assemblies one by one. This is an option that still can be exercised on the high-speed adjustable conveyor system 12 if needed. However, the operator of the high-speed adjustable conveyor system 12 has the advantage of easily adjusting three stop finger assemblies 122 simultaneously as opposed to one at a time. This adjustment may then force repositioning of the hold down strap assemblies 102. To simplify the whole process, the computer processing unit (not shown) of the high-speed adjustable conveyor system 12 has software and electronics necessary to automatically alter home position of the spring loaded collapsible fingers 70A, 70B, 70C, 70D, by simply selecting the document size to be run on the keyboard/monitor units 14A, 14B. This saves a considerable amount of time and reduces operator errors during job set-up.

Referring again to FIGS. 3–4, in assembling the products 28 in the high-speed adjustable conveyor system 12, the folded stacks of sheets 20 are collated on top of the previously fed inserts 26 as the folded stacks 20 and any inserts 26 are indexed down the high-speed adjustable conveyor system 12. This is necessary to ensure that the mailing address on the first sheet of the folded stack of sheets 20 shows through the window of the mailing envelope (not shown). In the event that closed faced envelopes are being used which would have the address printed on the outside thereof, the same collating process is used for simplicity. This collating process is accomplished because of the profile of the station guides. Each station comprises one pair of inner rails 46, a pair of outer rails 42 and two inner strap-ramps 80B, 80C. The two outer strap-ramps 80A, 80D are also used in the medium and wide modes of operation. The top surfaces of all of these components ramp upward at a two degree incline. The home positions of the stop fingers 128A, 128B, 128C, 128D (or just stop fingers 128B, 128C if narrow mode of operation is being used) and the spring loaded collapsible fingers 70A, 70B, 70C, 70D (or just inner spring loaded collapsible fingers 70B, 70C if narrow mode of operation is being used) are such that the product being assembled is staged near the high part of the two-degree incline. Meanwhile, the insert 26 to be added is staged near the low part of the two-degree incline in the next station. Hence, on the next index, the product staged at the high end of the incline is pushed on top of the insert 26 staged at the low end of the incline in the next station and advanced together to the high end of the same station. This process is repeated as required until the product is completed.

An additional feature of the high-speed adjustable conveyor system 12 of the present invention is greater flexibility offered by the mounting method for the insert feeders 24A, 24B, 24C. The standard type of feeder 24A, 24B used for the purpose of feeding inserts such as brochures is a friction feeder which are well known in the art. These feeders are very simple and easy to adjust and handle a wide range of materials. However, it should be noted that, although the friction feeder is very flexible and easy to adjust, it is not ideal for all materials. For this reason, the mounting method of the present invention allows a second type of well known feeder 26C which utilizes vacuum technology to replace the friction feeders. However, the problem has been that these feeder technologies are so different that they, could not be readily interchanged between one type and the other. To allow even greater flexibility in the high-speed adjustable conveyor system 12, both types of feeders are designed so as to share the same foot print and mounting method. The mounting method of the present invention allows for both feeder technologies which they can be interchanged in just minutes.

Figure 20:
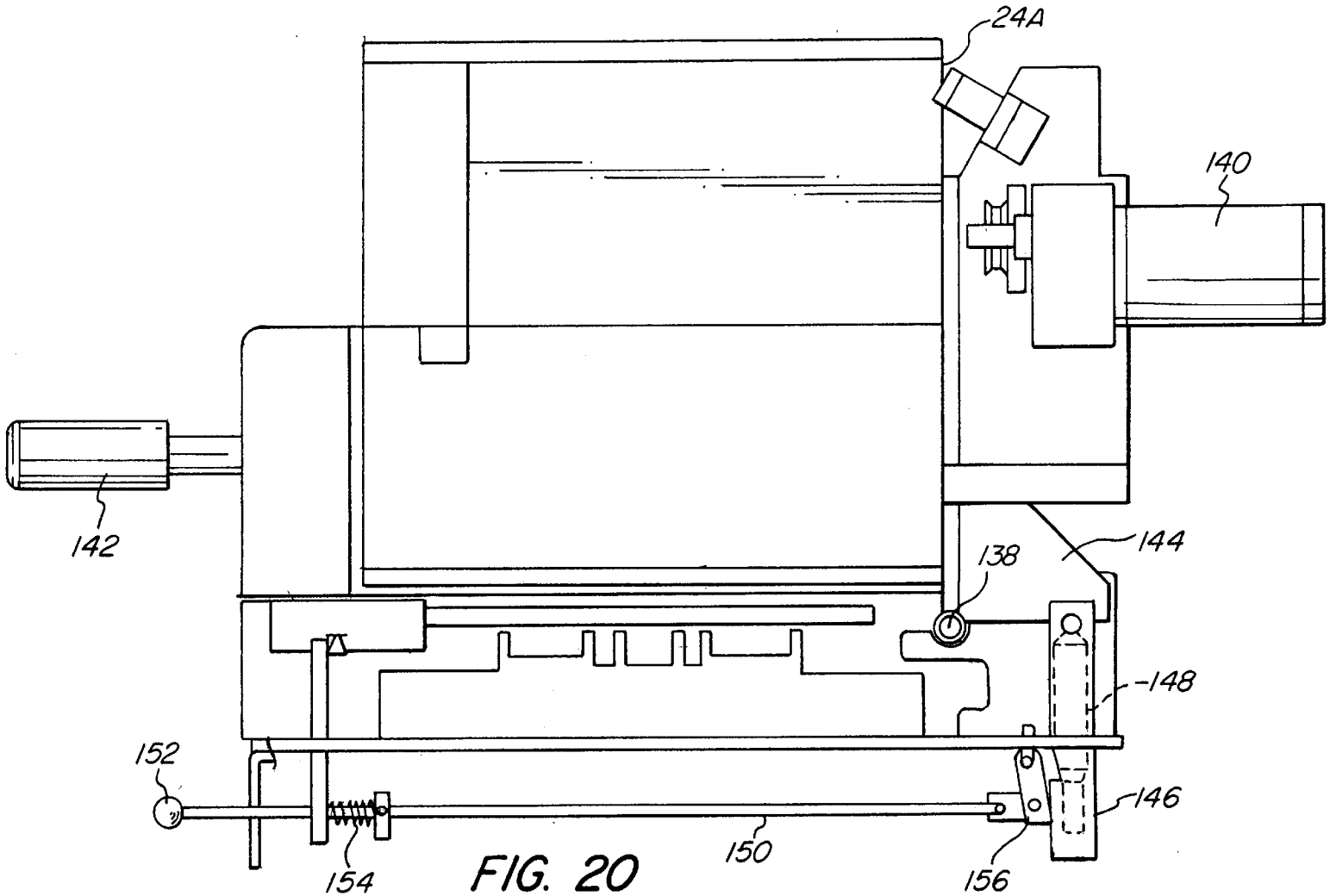
FIGS. 20 and 21 are schematic end elevational views of the apparatus of the present invention for conveying a product along a product conveying path illustrating one of the insert feeders in its lowered and raised positions, respectively.
Figure 21:
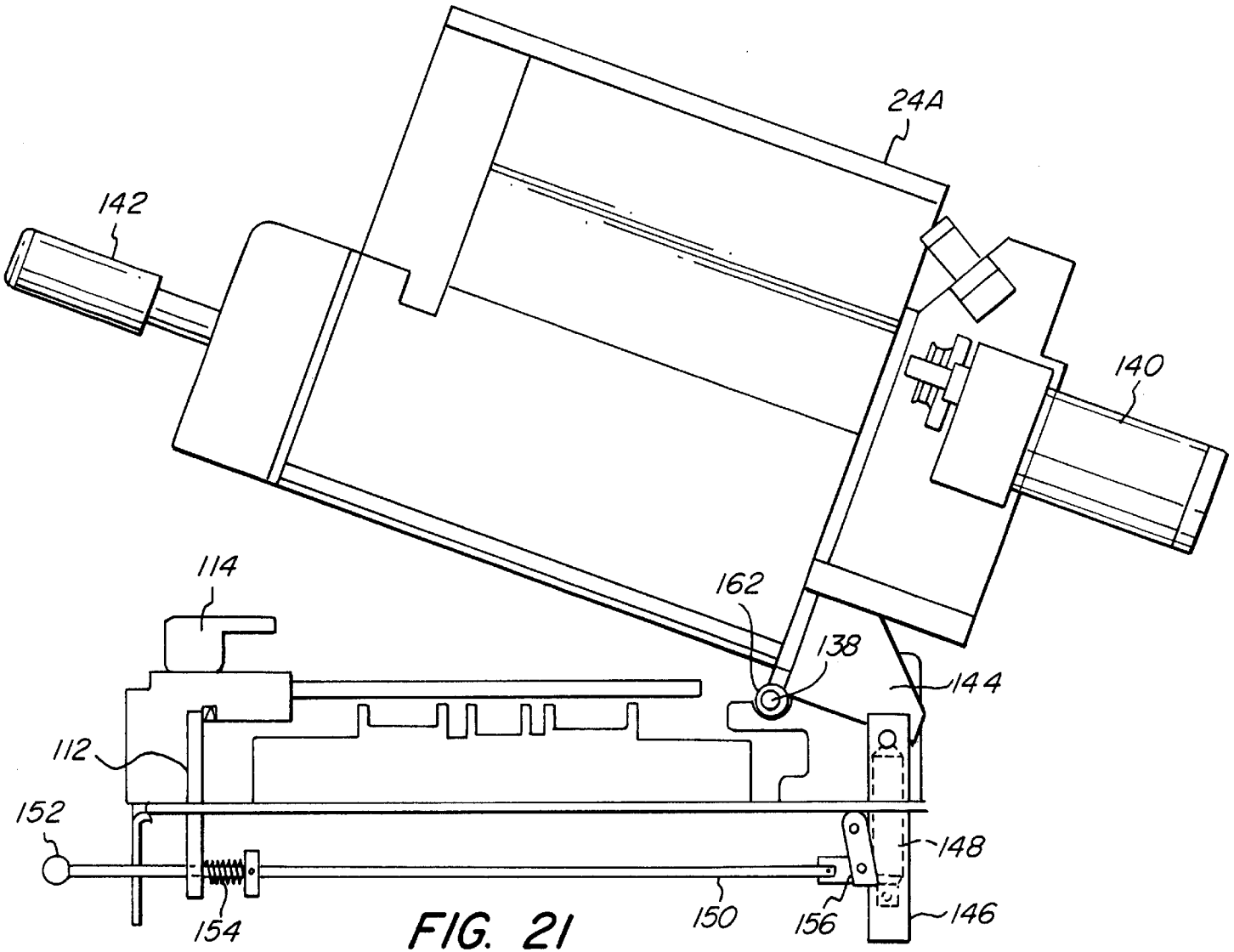

Turning to FIGS. 20 and 21, the mounting of one of the insert feeders 24A, 24B, 24C is shown but it is exemplary of all of the insert feeders 24A, 24B, 24C. The insert feeder 24A is pivotally mounted in a cantilevered manner from the backside of the high-speed adjustable conveyor system 12 on a pivot pin 138. Most of the heavy operating components of the insert feeder 24A including motor 140 are located to the rear of the pivot pin 138 to provide a mechanical advantage to the operator when the insert feeder 24A is raised by a feeder handle 142. Adjacent to the pivot pin 138 is a bracket 144 to which a slide latch 146 and a hydraulic cylinder motion control damper 148 are pivotally connected. The slide latch 144 is constrained for vertical rectilinear movement while the lower portion of the hydraulic cylinder motion control damper 148 is fastened to the module 38. A shaft 150 of a latch release knob 152 is biased by spring 154 and controls a hold-up catch 156.

Tipping the insert feeder 24A up for access is accomplished by the operator grasping the feeder handle 142 on the operator side of the module 38 and lifting the insert feeder 24A until the hold-up catch 154 engages the slide latch 146 as shown in FIG. 21. During this motion, the hydraulic cylinder motion control damper 148 provides no dampening to the upward motion of the insert feeder 24A.

To return the insert feeder 24A to normal operation the operator grasps the feeder handle 142 again, lifting slightly and pulling the latch release knob 152 located directly in front of the insert feeder 24A on the face of the module 38, and then lowering the insert feeder 24A back to its normal position shown in FIG. 20. This downward motion is also dampened by the hydraulic cylinder motion control damper 148. The insert feeder 24A and the computer processing unit (not shown) are interlocked so that the electronic finishing system 10 will not operate unless the feeder 24A is in its normal position.

The cantilever feeder mounting method for the feeders 24A, 24B, 24C allows for much improved visibility and access to the high-speed adjustable conveyor system 12 from the front or operator's side. The mounting method allows the operator to tip the feeders up and latch them in the up position. Now, with both hands free and the conveyor path fully exposed, the operator can easily make adjustments or remove jams. This feature assists tremendously in trouble shooting problems.

Figure 22:
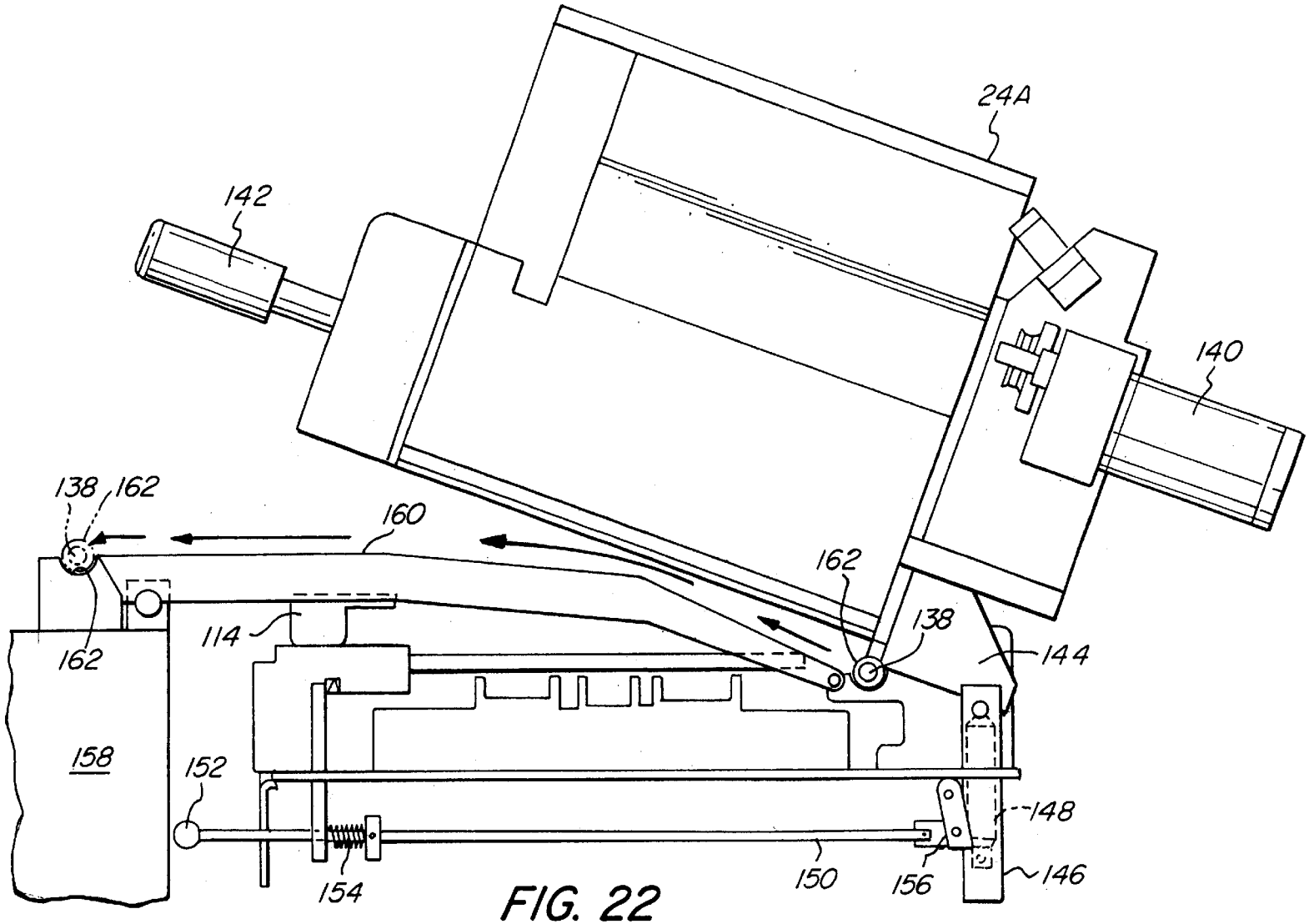
FIG. 22 is a schematic end elevational view of the apparatus of the present invention for conveying a product along a product conveying path illustrating one of the insert feeders in its raised position and being removed from the apparatus using a feeder cart.

In addition, the cantilever feeder mounting method for the insert feeders 24A, 24B, 24C facilitates the changing of the insert feeders. Referring to FIG. 22, removal of the insert feeder 24A can be simply accomplished by moving a feeder cart 158 adjacent the front of the adjustable conveyor system 12 with its feeder transfer bridge 160 positioned underneath the insert feeder 24A when the insert feeder 24A is in its raised position. Any electrical and/or vacuum connections must be disconnected and the bracket 144 must be decoupled from the slide latch 146. The insert feeder 24A can then be pivoted onto the feeder transfer bridge 160 and rolled completely onto the feeder transfer bridge 160 by means of the pivot pin 138 until the pivot pin 138 engages in a slot 162 on the feeder cart 158. The pivot pin 138 has a rotatable sleeve 164 thereon which facilitates this rolling movement. The feeder cart 158 with the insert feeder 24A thereon are then pulled away from the adjustable conveyor system 12 so another insert feeder can be introduced at the now vacant station by reversing the above mentioned removal process.

Although not explained in detail, it will be appreciated by those skilled in the art that the electronic finishing system 10 is event driven and appropriate sensors (e.g. well-known reflective sensors) are located throughout the electronic finishing system 10 including in the high-speed adjustable conveyor system 12 to ensure that the various components thereof are in the proper position during each sequence of operation. The computer processing unit (not shown) controls the operation of the entire electronic finishing system 10 including the high-speed adjustable conveyor system 12. This arrangement provides a fail safe system whereby damage to the machine is prevented and quality of the finished packages is assured.

Thus, artisans skilled in the art will appreciate that the high-speed adjustable conveyor system 12 of the present invention as described herein can be employed advantageously to receive folded stacks of sheets 20 and provide inserts 26 to the folded stacks of sheets .20 in an efficient and convenient manner. Therefore, it will be seen from the above that the invention described admirably achieves the objects of the invention. However, it will be appreciated that departures can be made by those skilled in the art without departing from the spirit and scope of the invention, which is limited only by the following claims.

Having thus described the invention, what is claimed is:

1. An apparatus for conveying a product along a product conveying path, the apparatus being adjustable to convey products of different widths, the apparatus comprising:

(a) a pusher device having first and second pushers for engaging a trailing end of the product to propel the product along the product conveying path, the first and second pushers being spaced from one another transversely across the conveying path, said first and second pushers being moveable between first and second positions transversely across the conveying path, said first and second pushers being closer to one another in the first position than in the second position thereby being adjustable to convey products of different widths; and (b) a mechanism for moving said pusher device so that said first and second pushers move along the product conveying path to propel the product engaged at the trailing end thereof by said first and second pushers along the product conveying path.

2. The apparatus for conveying a product along a product conveying path in accordance with claim 1, wherein said moving mechanism is a chain drive with an indexing motor drivingly engaged therewith.

3. The apparatus for conveying a product along a product conveying path in accordance with claim 2, wherein said chain drive is a pair of spaced chains pinned together at spaced intervals and operationally connected to at least two dual sprocket wheels so as move said first and second pushers in an endless path, part of the endless path extends into the product conveying path.

4. The apparatus for conveying a product along a product conveying path in accordance with claim 1, wherein said moving mechanism includes an indexing motor and a manual mechanism for moving said pusher device.

5. The apparatus for conveying a product along a product conveying path in accordance with claim 1, wherein said pusher device further including third and fourth pushers for engaging a trailing end of the product to propel the product along the product conveying path, said third and fourth pushers being spaced from one another transversely across the conveying path between said first and second pushers.

6. The apparatus for conveying a product along a product conveying path in accordance with claim 5, wherein said first, second, third and fourth pushers are spring loaded collapsible fingers.

7. The apparatus for conveying a product along a product conveying path in accordance with claim 5, wherein said first and second pushers are removable from said pusher device leaving just said third and fourth pushers for engaging a trailing end of the product to propel the product along the product conveying path.

8. The apparatus for conveying a product along a product conveying path in accordance with claim 1, wherein said first and second pushers are spring loaded collapsible fingers.

9. The apparatus for conveying a product along a product conveying path in accordance with claim 1, wherein there are a plurality of said pusher devices sequentially attached to said moving mechanism, each of said pusher devices for engaging a trailing end of a product to propel the product along the product conveying path.

10. An apparatus for conveying a product along a product conveying path, the apparatus being adjustable to convey products of different widths, the apparatus comprising:

(a) a pair of inner opposed rails for supporting the product as it is propelled along the product conveying path, said pair of inner opposed rails being adjustable between at least two distinct positions to permit conveying products of different widths; and (b) a pair of outer opposed rails cooperating with said pair of inner opposed rails for supporting the product as it is propelled along the product conveying path, said pair of outer opposed rails being adjustable relative to and independent of said pair of inner opposed rails to permit conveying of products of different widths, each of said outer opposed rails having a base portion for supporting the product as it is propelled along the product conveying path and an upstanding portion for guiding the product as it is propelled along the product conveying path.

11. The apparatus for conveying a product along a product conveying path in accordance with claim 10, wherein said base portions on said pair of outer opposed rails nest with said pair of inner opposed rails thereby providing continuous support without gaps for at least edge portions of the product as it is propelled along the product conveying path.

12. The apparatus for conveying a product along a product conveying path in accordance with claim 10, wherein said pair of outer opposed rails operationally cooperate with each other to move simultaneously during adjustment.

13. The apparatus for conveying a product along a product conveying path in accordance with claim 10, wherein said pair of inner opposed rails operationally cooperate with each other to move simultaneously during adjustment.

14. The apparatus for conveying a product along a product conveying path in accordance with claim 10, wherein there are a plurality of said pairs of inner opposed rails and said pairs of outer opposed rails along the product conveying path.

15. The apparatus for conveying a product along a product conveying path in accordance with claim 14, wherein each pair of outer opposed rails are angled toward each other whereby trailing ends of each pair of outer opposed rails are closer than leading ends of each pair of outer opposed rails to align the product being propelled along the product conveying path at the trailing ends of each pair of outer opposed rails.

16. An apparatus for conveying a product along a product conveying path, the apparatus being adjustable to convey products of different widths, the apparatus comprising:

(a) a strap support device having first and second straps for supporting the product being propelled along the product conveying path, said first and second straps being spaced from one another transversely across the product conveying path, said first and second straps being moveable between first and second positions, said first and second straps being located to support the product being propelled along the product conveying path in the first position and being located not to support the product being propelled along the product conveying path in the second position thereby being adjustable to convey products of different widths; and (b) a mechanism for moving said first and second straps of said strap support device between said first and second positions.

17. The apparatus for conveying a product along a product conveying path in accordance with claim 16, wherein said moving mechanism is a strap tensioning device with said first and second straps wrapped therearound.

18. The apparatus for conveying a product along a product conveying path in accordance with claim 16, further including ramps attached to said first and second straps.

19. The apparatus for conveying a product along a product conveying path in accordance with claim 18, wherein said ramps are inclined plastic ramps.

20. The apparatus for conveying a product along a product conveying path in accordance with claim 16, wherein said strap support device further including third and fourth straps for supporting the product being propelled along the product conveying path, said third and fourth straps being spaced from one another transversely across the conveying path between said first and second straps.

21. The apparatus for conveying a product along a product conveying path in accordance with claim 20, wherein, when said first and second straps are in the second position, said third and fourth straps support the product being propelled along the product conveying path.

22. The apparatus for conveying a product along a product conveying path in accordance with claim 20, wherein said third and fourth straps are attached to a strap tensioning device for controlling tension therein.

23. A hold down assembly for an apparatus for conveying a product along a product conveying path, the apparatus being adjustable to convey products of different widths, the hold down assembly comprising:

(a) a hold down support device extending over the product conveying path, said hold down support device is cantilevered over the product conveying path from one side thereof; and (b) a t least one strap removeably mounted on said hold down support device for holding the product flat on the conveyor path and helping decelerate the product at an indexing movement of the product.

24. The hold down assembly for an apparatus for conveying a product along a product conveying path in accordance with claim 23, wherein said hold down support device has a clamping mechanism which removeably attaches to a rail extending along one side of the product conveying path.

25. A hold down assembly for an apparatus for conveying a product along a product conveying path, the apparatus being adjustable to convey products of different widths, the hold down assembly comprising:

(a) a hold down support device extending over the product conveying path, said hold down support device has a shaft with a slot therein; and (b) at least one strap removeably mounted on said hold down support device for holding the product flat on the conveyor path and helping decelerate the product at an indexing movement of the product, said at least one strap being removably attached into said slot in said shaft.

26. The hold down assembly for an apparatus for conveying a product along a product conveying path in accordance with claim 25, further including a resilient clip for retaining each at least one straps on said shaft.

27. A stop finger assembly for an apparatus for conveying a product along a product conveying path, the apparatus being adjustable to convey products of different widths, the stop finger assembly comprising:

(a) a stop finger support device cantilevered over the product conveying path;

(b) at least one stop finger removeably mounted on said stop finger support device for stopping the product following an indexing movement of the product; and (c) a mechanism for moving said stop finger support device so that said at least one stop finger moves into the product conveying path to engaged the product at a leading end thereof following an indexing movement of the product and moves out of the product conveying path to begin an indexing movement of the product.

28. The stop finger assembly for an apparatus for conveying a product along a product conveying path in accordance with claim 27, wherein said stop finger support device is cantilevered over the product conveying path from one side thereof.

29. The stop finger assembly for an apparatus for conveying a product along a product conveying path in accordance with claim 28, wherein said stop finger support device has a clamping mechanism which removeably attaches to a rail extending along one side of the product conveying path.

30. The stop finger assembly for an apparatus for conveying a product along a product conveying path in accordance with claim 27, wherein said moving mechanism rotates said stop finger support device to move said at least one stop finger attached thereto into the product conveying path to engaged the product at a leading end thereof following an indexing movement of the product and out of the product conveying path to begin an indexing movement of the product.

31. The stop finger assembly for an apparatus for conveying a product along a product conveying path in accordance with claim 27, wherein said moving mechanism is a piston-cylinder arrangement operationally connected to said stop finger support device.

32. An apparatus for conveying a product along a product conveying path, the apparatus comprising:

(a) a conveyor system for conveying the product along the product conveying path; and (b) an insert feeder spaced above said conveyor system for feeding at least one insert onto said conveyor system so as to be combined with the product as the product is conveyed along the product conveyor path, said insert feeder is pivotally mounted adjacent the product conveyor path whereby said insert feeder can be rotated between an operative position spaced above said conveyor system for feeding at least one insert onto said conveyor system so as to be combined with the product as the product is conveyed along the product conveyor path and a raised inoperative position spaced farther from the product conveyor path to provide access to the product conveyor path.

33. The apparatus for conveying a product along a product conveying path in accordance with claim 32, further comprising a latching mechanism for holding said insert feeder in the raised inoperative position spaced farther from the product conveyor path to provide access to the product conveyor path.

34. The apparatus for conveying a product along a product conveying path in accordance with claim 32, further comprising a motion control damper for dampening movement of said insert feeder when said insert feeder is moved from the raised inoperative position to the operative position.

35. The apparatus for conveying a product along a product conveying path in accordance with claim 32, further comprising a device for removing said insert feeder from said conveyor system.

36. The apparatus for conveying a product along product conveying path in accordance with claim 35, wherein said removing device includes a feeder transfer bridge for transferring said insert feeder off said conveyor system.

37. The apparatus for conveying a product along a product conveying path in accordance with claim 36, wherein said feeder transfer bridge is cantilevered from a free standing feeder cart.

38. An apparatus for conveying a product along a product conveying path, the apparatus being adjustable to convey products of different widths, the apparatus comprising:

(a) a conveyor system for conveying the product along the product conveying path, the conveyor system comprising:

(i) a pusher device having first and second pushers for engaging a trailing end of the product to propel the product along the product conveying path, said first and second pushers being spaced from one another transversely across the conveying path, said first and second pushers being moveable between first and second positions transversely across the conveying path, said first and second pushers being closer to one another in the first position than in the second position thereby being adjustable to convey products of different widths; and a mechanism for moving said pusher device so that said first and second pushers move along the product conveying path to propel the product engaged at the trailing end thereof by said first and second pushers along the product conveying path;

(ii) a pair of inner opposed rails for supporting the product as it is propelled along the product conveying path, said pair of inner opposed rails being adjustable between at least two distinct positions to permit conveying products of different widths;

(iii) a pair of outer opposed rails cooperating with said pair of inner opposed rails for supporting the product as it is propelled along the product conveying path, said pair of outer opposed rails being adjustable relative to and independent of said pair of inner opposed rails to permit conveying of products of different widths, each of the outer opposed rails having a base portion for supporting the product as it is propelled along the product conveying path and an upstanding portion for guiding the product as it is propelled along the product conveying path;

(iv) a strap support device having first and second straps for supporting the product being propelled along the product conveying path, said first and second straps being spaced from one another transversely across the product conveying path, said first and second straps being moveable between first and second positions, said first and second straps being located to support the product being propelled along the product conveying path in the first position and being located not to support the product being propelled along the product conveying path in the second position thereby being adjustable to convey products of different widths, and a mechanism for moving said first and second straps of said strap support device between said first and second positions;

(b) a hold down assembly comprising:

(i) a hold down support device extending over the product conveying path; and (ii) at least one hold down strap removeably mounted on said hold down support device for holding the product flat on the conveyor path and helping decelerate the product at an indexing movement of the product;

(c) a stop finger assembly comprising:

(i) a stop finger support device cantilevered over the product conveying path;

(ii) at least one stop finger removeably mounted on said stop finger support device for stopping the product following an indexing movement of the product; and (iii) a mechanism for moving said stop finger support device so that said at least one stop finger moves into the product conveying path to engaged the product at a leading end thereof following an indexing movement of the product and moves out of the product conveying path to begin an indexing movement of the product; and (g) an insert feeder spaced above said conveyor system for feeding at least one insert onto said conveyor system so as to be combined with the product as the product is conveyed along the product conveyor path, said insert feeder is pivotally mounted adjacent the product conveyor path whereby said insert feeder can be rotated between an operative position spaced above said conveyor system for feeding at least one insert onto said conveyor system so as to be combined with the product as the product is conveyed along the product conveyor path and a raised inoperative position spaced farther from the product conveyor path to provide access to the product conveyor path.

39. A method for conveying a product along a product conveying path and permitting products of different widths to be conveyed, the method comprising the steps of:

(a) providing a pusher device having first and second pushers for engaging a trailing end of the product to propel the product along the product conveying path, said first and second pushers being spaced from one another transversely across the conveying path, said first and second pushers being moveable between first and second positions transversely across the conveying path, said first and second pushers being closer to one another in the first position than in the second position thereby being adjustable to convey products of different widths; and (b) moving said pusher device so that said first and second pushers move along the product conveying path to propel the product engaged at the trailing end thereof by said first and second pushers along the product conveying path.

40. The method for conveying a product along a product conveying path in accordance with claim 39, wherein said moving mechanism is a chain drive with an indexing motor drivingly engaged therewith.

41. The method for conveying a product along a product conveying path in accordance with claim 40, wherein said chain drive is a pair of spaced chains pinned together at spaced intervals and operationally connected to at least two dual sprocket wheels so as move said first and second pushers in an endless path, part of the endless path extends into the product conveying path.

42. The method for conveying a product along a product conveying path in accordance with claim 29, wherein said moving mechanism includes an indexing motor and a manual mechanism for moving said pusher device.

43. The method for conveying a product along a product conveying path in accordance with claim 29, wherein said pusher device further including third and fourth pushers for engaging a trailing end of the product to propel the product along the product conveying path, said third and fourth pushers being spaced from one another transversely across the conveying path between said first and second pushers.

44. The method for conveying a product along a product conveying path in accordance with claim 43, wherein said first, second, third and fourth pushers are spring loaded collapsible fingers.

45. The method for conveying a product along a product conveying path in accordance with claim 43, wherein said first and second pushers are removable from the pusher device leaving just said third and fourth pushers for engaging a trailing end of the product to propel the product along the product conveying path.

46. The method for conveying a product along a product conveying path in accordance with claim 39, wherein said first and second pushers are spring loaded collapsible fingers.

47. The method for conveying a product along a product conveying path in accordance with claim 39, wherein there are a plurality of said pusher devices sequentially attached to said moving mechanism, each of said pusher devices for engaging a trailing end of a product to propel the product along the product conveying path.

48. A method for conveying a product along a product conveying path and permitting products of different widths to be conveyed, the method comprising the steps of:

(a) providing a pair of inner opposed rails supporting the product as it is propelled along the product conveying path, said pair of inner opposed rails being adjustable between at least two distinct positions to permit conveying products of different widths; and (b) providing a pair of outer opposed rails cooperating with said pair of inner opposed rails supporting the product as it is propelled along the product conveying path, said pair of outer opposed rails being adjustable relative to and independent of said pair of inner opposed rails to permit conveying of products of different widths, each of the outer opposed rails having a base portion for supporting the product as it is propelled along the product conveying path and an upstanding portion for guiding the product as it is propelled along the product conveying path.

49. The method for conveying a product along a product conveying path in accordance with claim 48, wherein said base portions on said pair of outer opposed rails nest with said pair of inner opposed rails thereby providing continuous support without gaps for at least edge portions of the product as it is propelled along the product conveying path.

50. The method for conveying a product along a product conveying path in accordance with claim 48, wherein said pair of outer opposed rails operationally cooperate with each other to move simultaneously during adjustment.

51. The method for conveying a product along a product conveying path in accordance with claim 48, wherein said pair of inner opposed rails operationally cooperate with each other to move simultaneously during adjustment.

52. The method for conveying a product along a product conveying path in accordance with claim 48, wherein there are a plurality of said pairs of inner opposed rails and said pairs of outer opposed rails along the product conveying path.

53. The method for conveying a product along a product conveying path in accordance with claim 52, wherein each pair of outer opposed rails are angled toward each other whereby trailing ends of each pair of outer opposed rails are closer than leading ends of each pair of outer opposed rails to align the product being propelled along the product conveying path at the trailing ends of each pair of outer opposed rails.

54. A method for conveying a product along a product conveying path and permitting products of different widths to be conveyed, the method comprising the steps of:

(a) providing a strap support device having first and second straps for supporting the product being propelled along the product conveying path, said first and second straps being spaced from one another transversely across the product conveying path, said first and second straps being moveable between first and second positions, said first and second straps being located to support the product being propelled along the product conveying path in the first position and being located not to support the product being propelled along the product conveying path in the second position thereby being adjustable to convey products of different widths; and (b) moving said first and second straps of said strap support device between said first and second positions.

55. The method for conveying a product along a product conveying path in accordance with claim 54, wherein said moving step includes using a strap tensioning device which has said first and second straps wrapped therearound.

56. The method for conveying a product along a product conveying path in accordance with claim 54, further including providing ramps attached to said first and second straps.

57. The method for conveying a product along a product conveying path in accordance with claim 56, wherein said ramps are inclined plastic ramps.

58. The method for conveying a product along a product conveying path in accordance with claim 54, wherein said strap support device further including third and fourth straps for supporting the product being propelled along the product conveying path, said third and fourth straps being spaced from one another transversely across the conveying path between said first and second straps.

59. The method for conveying a product along a product conveying path in accordance with claim 58, wherein, when said first and second straps are in the second position, said third and fourth straps support the product being propelled along the product conveying path.

60. The method for conveying a product along a product conveying path in accordance with claim 58, wherein said third and fourth straps are attached to a strap tensioning device for controlling tension therein.

61. A method for conveying a product along a product conveying path using a hold down assembly, the method comprising the steps of:

(a) providing a hold down support device extending over the product conveying path, said hold down support device is cantilevered over the product conveying path from one side thereof; and (b) using at least one strap removeably mounted on said hold down support device to hold the product flat-on the conveyor path and helping decelerate the product at an indexing movement of the product.

62. The method for conveying a product along a product conveying path in accordance with claim 61, wherein said hold down support device has a clamping mechanism which removeably attaches to a rail extending along one side of the product conveying path.

63. A method for conveying a product along a product conveying path using a hold down assembly, the method comprising the steps of:

(a) providing a hold down support device extending over the product conveying path, said hold down support device has a shaft with a slot therein; and (b) using at least one strap removeably mounted on said hold down support device to hold the product flat on the conveyor path and helping decelerate the product at an indexing movement of the product, said at least one strap being removably attached into said slot in said shaft.

64. The method for conveying a product along a product conveying path in accordance with claim 63, further including the step of using a resilient clip to retain each at least one straps on said shaft.

65. A method for conveying a product along a product conveying path using a stop finger assembly, the method comprising the steps of:

(a) providing a stop finger support device cantilevered over the product conveying path;

(b) using at least one stop finger removeably mounted on said stop finger support device for stopping the product following an indexing movement of the product; and (c) moving said stop finger support device so that said at least one stop finger moves into the product conveying path to engaged the product at a leading end thereof following an indexing movement of the product and moves out of the product conveying path to begin an indexing movement of the product.

66. The method for conveying a product along a product conveying path in accordance with claim 65, wherein said stop finger support device is cantilevered over the product conveying path from one side thereof.

67. The method for conveying a product along a product conveying path in accordance with claim 66, wherein said stop finger support device has a clamping mechanism which removeably attaches to a rail extending along one side of the product conveying path.

68. The method for conveying a product along a product conveying path in accordance with claim 65, wherein said stop finger support device rotates during said moving step to move said at least one stop finger attached thereto into the product conveying path to engaged the product at a leading end thereof following an indexing movement of the product and out of the product conveying path to begin an indexing movement of the product.

69. The method for conveying a product along a product conveying path in accordance with claim 65, wherein said moving step is performed by a piston-cylinder arrangement operationally connected to said stop finger support device.

70. A method for conveying a product along a product conveying path, the method comprising the steps of:

(a) providing a conveying system conveying the product along the product conveying path; and (b) using an insert feeder spaced above said conveyor system for feeding at least one insert onto said conveyor system so as to be combined with the product as the product is conveyed along the product conveyor path, said insert feeder is pivotally mounted adjacent the product conveyor path whereby said insert feeder can be rotated between an operative position spaced above said conveyor system for feeding at least one insert onto said conveyor system so as to be combined with the product as the product is conveyed along the product conveyor path and a raised inoperative position spaced farther from the product conveyor path to provide access to the product conveyor path.

71. The method for conveying a product along a product conveying path in accordance with claim 70, further comprising the step of using a latching mechanism to hold said insert feeder in the raised inoperative position spaced farther from the product conveyor path to provide access to the product conveyor path.

72. The method for conveying a product along a product conveying path in accordance with claim 70, further comprising the step of using a motion control damper to dampen movement of said insert feeder when said insert feeder is moved from the raised inoperative position to the operative position.

73. The method for conveying a product along a product conveying path in accordance with claim 70, further comprising the step of providing a device for removing said insert feeder from said conveyor system.

74. The method for conveying a product along a product conveying path in accordance with claim 73, wherein said removing device includes a feeder transfer bridge for transferring said insert feeder off said conveyor system.

75. The method for conveying a product along a product conveying path in accordance with claim 74, wherein said feeder transfer bridge is cantilevered from a free standing feeder cart.

76. A method for conveying a product along a product conveying path and permitting products of different widths to be conveyed, the method comprising the steps of:

(a) providing a conveyor system for conveying the product along the product conveying path, the conveyor system comprising:

(i) a pusher device having first and second pushers for engaging a trailing end of the product to propel the product along the product conveying path, said first and second pushers being spaced from one another transversely across the conveying path, said first and second pushers being moveable between first and second positions transversely across the conveying path, said first and second pushers being closer to one another in the first position than in the second position thereby being adjustable to convey products of different widths; and a mechanism for moving said pusher device so that said first and second pushers move along the product conveying path to propel the product engaged at the trailing end thereof by said first and second pushers along the product conveying path;

(ii) a pair of inner opposed rails for supporting the product as it is propelled along the product conveying path, said pair of inner opposed rails being adjustable between at least two distinct positions to permit conveying products of different widths; and (iii) a pair of outer opposed rails cooperating with said pair of inner opposed rails for supporting the product as it is propelled along the product conveying path, said pair of outer opposed rails being adjustable relative to and independent of said pair of inner opposed rails to permit conveying of products of different widths, each of the outer opposed rails having a base portion for supporting the product as it is propelled along the product conveying path and an upstanding portion for guiding the product as it is propelled along the product conveying path;

(iv) a strap support device having first and second straps for supporting the product being propelled along the product conveying path, said first and second straps being spaced from one another transversely across the product conveying path, said first and second straps being moveable between first and second positions, said first and second straps being located to support the product being propelled along the product conveying path in the first position and being located not to support the product being propelled along the product conveying path in the second position thereby being adjustable to convey products of different widths, and a mechanism for moving said first and second straps of said strap support device between said first and second positions;

(b) using a hold down assembly comprising:

(i) a hold down support device extending over the product conveying path; and (ii) at least hold down one strap removeably mounted on said hold down support device to hold the product flat on the conveyor path and helping decelerate the product at an indexing movement of the product;

(c) using a stop finger assembly comprising:

(i) a stop finger support device cantilevered over the product conveying path;

(ii) at least one stop finger removeably mounted on said stop finger support device to stop the product following an indexing movement of the product; and (iii) moving said stop finger support device so that said at least one stop finger moves into the product conveying path to engaged the product at a leading end thereof following an indexing movement of the product and moves out of the product conveying path to begin an indexing movement of the product; and (g) using an insert feeder spaced above said conveyor system to feeding at least one insert onto said conveyor system so as to be combined with the product as the product is conveyed along the product conveyor path, said insert feeder is pivotally mounted adjacent the product conveyor path whereby said insert feeder can be rotated between an operative position spaced above said conveyor system for feeding at least one insert onto said conveyor system so as to be combined with the product as the product is conveyed along the product conveyor path and a raised inoperative position spaced farther from the product conveyor path to provide access to the product conveyor path.

77. The apparatus for conveying a product along a product conveying path in accordance with claim 32, wherein the insert feeder is selected from the group consisting of friction insert feeder and vacuum insert feeder.

78. The apparatus for conveying a product along a product conveying path in accordance with claim 35, wherein the insert feeder is selected from the group consisting of friction insert feeder and vacuum insert feeder.

79. The method for conveying a product along a product conveying path in accordance with claim 70, wherein the insert feeder is selected from the group consisting of friction insert feeder and vacuum insert feeder.

80. The method for conveying a product along a product conveying path in accordance with claim 73, wherein the insert feeder is selected from the group consisting of friction insert feeder and vacuum insert feeder.

81. The apparatus for conveying a product along a product conveying path in accordance with claim 38, further comprising a latching mechanism for holding said insert feeder in the raised inoperative position spaced farther from the product conveyor path to provide access to the product conveyor path.

82. The apparatus for conveying a product along a product conveying path in accordance with claim 38, further comprising a motion control damper for dampening movement of said insert feeder when said insert feeder is moved from the raised inoperative position to the operative position.

83. The apparatus for conveying a product along a product conveying path in accordance with claim 38, further comprising a device for removing said insert feeder from said conveyor system.

84. The apparatus for conveying a product along a product conveying path in accordance with claim 83, wherein said removing device includes a feeder transfer bridge for transferring said insert feeder off said conveyor system.

85. The apparatus for conveying a product along a product conveying path in accordance with claim 84, wherein said feeder transfer bridge is cantilevered from a free standing feeder cart.

86. The apparatus for conveying a product along a product conveying path in accordance with claim 83, wherein the insert feeder is selected from the group consisting of friction insert feeder and vacuum insert feeder.

87. The apparatus for conveying a product along a product conveying path in accordance with claim 38, wherein the insert feeder is selected from the group consisting of friction insert feeder and vacuum insert feeder.

88. The method for conveying a product along a product conveying path in accordance with claim 76, further comprising the step of using a latching mechanism to hold said insert feeder in the raised inoperative position spaced farther from the product conveyor path to provide access to the product conveyor path.

89. The method for conveying a product along a product conveying path in accordance with claim 76, further comprising the step of using a motion control damper to dampen movement of said insert feeder when said insert feeder is moved from the raised inoperative position to the operative position.

90. The method for conveying a product along a product conveying path in accordance with claim 76, further comprising the step of providing a device for removing said insert feeder from said conveyor system.

91. The method for conveying a product along a product conveying path in accordance with claim 90, wherein said removing device includes a feeder transfer bridge for transferring said insert feeder off said conveyor system.

92. The method for conveying a product along a product conveying path in accordance with claim 91, wherein said feeder transfer bridge is cantilevered from a free standing feeder cart.

93. The method for conveying a product along a product conveying path in accordance with claim 90, wherein the insert feeder is selected from the group consisting of friction insert feeder and vacuum insert feeder.

94. The method for conveying a product along a product conveying path in accordance with claim 76, wherein the insert feeder is selected from the group consisting of friction insert feeder and vacuum insert feeder.

95. The apparatus for conveying a product along a product conveying path in accordance with claim 38, wherein said moving mechanism is a chain drive with an indexing motor drivingly engaged therewith.

96. The apparatus for conveying a product along a product conveying path in accordance with claim 95, wherein said chain drive is a pair of spaced chains pinned together at spaced intervals and operationally connected to at least two dual sprocket wheels so as move said first and second pushers in an endless path, part of the endless path extends into the product conveying path.

97. The apparatus for conveying a product along a product conveying path in accordance with claim 38, wherein said moving mechanism includes an indexing motor and a manual mechanism for moving said pusher device.

98. The apparatus for conveying a product along a product conveying path in accordance with claim 38, wherein said pusher device further including third and fourth pushers for engaging a trailing end of the product to propel the product along the product conveying path, said third and fourth pushers being spaced from one another transversely across the conveying path between said first and second pushers.

99. The apparatus for conveying a product along a product conveying path in accordance with claim 98, wherein said first, second, third and fourth pushers are spring loaded collapsible fingers.

100. The apparatus for conveying a product along a product conveying path in accordance with claim 98, wherein said first and second pushers are removable from said pusher device leaving just said third and fourth pushers for engaging a trailing end of the product to propel the product along the product conveying path.

101. The apparatus for conveying a product along a product conveying path in accordance with claim 38, wherein said first and second pushers are spring loaded collapsible fingers.

102. The apparatus for conveying a product along a product conveying path in accordance with claim 38, wherein there are a plurality of said pusher devices sequentially attached to said moving mechanism, each of said pusher devices for engaging a trailing end of a product to propel the product along the product conveying path.

103. The apparatus for conveying a product along a product conveying path in accordance with claim 38, wherein said base portions on said pair of outer opposed rails nest with said pair of inner opposed rails thereby providing continuous support without gaps for at least edge portions of the product as it is propelled along the product conveying path.

104. The apparatus for conveying a product along a product conveying path in accordance with claim 38, wherein said pair of outer opposed rails operationally cooperate with each other to move simultaneously during adjustment.

105. The apparatus for conveying a product along a product conveying path in accordance with claim 38, wherein said pair of inner opposed rails operationally cooperate with each other to move simultaneously during adjustment.

106. The apparatus for conveying a product along a product conveying path in accordance with claim 38, wherein there are a plurality of said pairs of inner opposed rails and said pairs of outer opposed rails along the product conveying path.

107. The apparatus for conveying a product along a product conveying path in accordance with claim 106, wherein each pair of outer opposed rails are angled toward each other whereby trailing ends of each pair of outer opposed rails are closer than leading ends of each pair of outer opposed rails to align the product being propelled along the product conveying path at the trailing ends of each pair of outer opposed rails.

108. The apparatus for conveying a product along a product conveying path in accordance with claim 38, wherein said moving mechanism is a strap tensioning device with said first and second straps wrapped therearound.

109. The apparatus for conveying a product along a product conveying path in accordance with claim 38, further including ramps attached to said first and second straps.

110. The apparatus for conveying a product along a product conveying path in accordance with claim 109, wherein said ramps are inclined plastic ramps.

111. The apparatus for conveying a product along a product conveying path in accordance with claim 38, wherein said strap support device further including third and fourth straps for supporting the product being propelled along the product conveying path, said third and fourth straps being spaced from one another transversely across the conveying path between said first and second straps.

112. The apparatus for conveying a product along a product conveying path in accordance with claim 111, wherein, when said first and second straps are in the second position, said third and fourth straps support the product being propelled along the product conveying path.

113. The apparatus for conveying a product along a product conveying path in accordance with claim 111, wherein said third and fourth straps are attached to a strap tensioning device for controlling tension therein.

114. The apparatus for conveying a product along a product conveying path in accordance with claim 38, wherein said hold down support device is cantilevered over the product conveying path from one side thereof.

115. The apparatus for conveying a product along a product conveying path in accordance with claim 114, wherein said hold down support device has a clamping mechanism which removeably attaches to a rail extending along one side of the product conveying path.

116. The apparatus for conveying a product along a product conveying path in accordance with claim 38, wherein said hold down support device has a shaft with a slot therein into which said at least one strap is removably attached.

117. The apparatus for conveying a product along a product conveying path in accordance with claim 116, further including a resilient clip for retaining each at least one straps on said shaft.

118. The apparatus for conveying a product along a product conveying path in accordance with claim 38, wherein said stop finger support device is cantilevered over the product conveying path from one side thereof.

119. The apparatus for conveying a product along a product conveying path in accordance with claim 118, wherein said stop finger support device has a clamping mechanism which removeably attaches to a rail extending along one side of the product conveying path.

120. The apparatus for conveying a product along a product conveying path in accordance with claim 38, wherein said moving mechanism rotates said stop finger support device to move said at least one stop finger attached thereto into the product conveying path to engaged the product at a leading end thereof following an indexing movement of the product and out of the product conveying path to begin an indexing movement of the product.

121. The apparatus for conveying a product along a product conveying path in accordance with claim 38, wherein said moving mechanism is a piston-cylinder arrangement operationally connected to said stop finger support device.

122. The method for conveying a product along a product conveying path in accordance with claim 76, wherein said moving mechanism is a chain drive with an indexing motor drivingly engaged therewith.

123. The method for conveying a product along a product conveying path in accordance with claim 122, wherein said chain drive is a pair of spaced chains pinned together at spaced intervals and operationally connected to at least two dual sprocket wheels so as move said first and second pushers in an endless path, part of the endless path extends into the product conveying path.

124. The method for conveying a product along a product conveying path in accordance with claim 76, wherein said moving mechanism includes an indexing motor and a manual mechanism for moving said pusher-device.

125. The method for conveying a product along a product conveying path in accordance with claim 76, wherein said pusher device further including third and fourth pushers for engaging a trailing end of the product to propel the product along the product conveying path, said third and fourth pushers being spaced from one another transversely across the conveying path between said first and second pushers.

126. The method for conveying a product along a product conveying path in accordance with claim 125, wherein said first, second, third and fourth pushers are spring loaded collapsible fingers.

127. The method for conveying a product along a product conveying path in accordance with claim 125, wherein said first and second pushers are removable from the pusher device leaving just said third and fourth pushers for engaging a trailing end of the product to propel the product along the product conveying path.

128. The method for conveying a product along a product conveying path in-accordance with claim 76, wherein said first and second pushers are spring loaded collapsible fingers.

129. The method for conveying a product along a product conveying path in accordance with claim 76, wherein there are a plurality of said pusher devices sequentially attached to said moving mechanism, each of said pusher devices for engaging a trailing end of a product to propel the product along the product conveying path.

130. The method for conveying a product along a product conveying path in accordance with claim 76, wherein said base portions on said pair of outer opposed rails nest with said pair of inner opposed rails thereby providing continuous support without gaps for at least edge portions of the product as it is propelled along the product conveying path.

131. The method for conveying a product along a product conveying path in accordance with claim 76, wherein said pair of outer opposed rails operationally cooperate with each other to move simultaneously during adjustment.

132. The method for conveying a product along a product conveying path in accordance with claim 76, wherein said pair of inner opposed rails operationally cooperate with each other to move simultaneously during adjustment.

133. The method for conveying a product along a product conveying path in accordance with claim 76, wherein there are a plurality of said pairs of inner opposed rails and said pairs of outer opposed rails along the product conveying path.

134. The method for conveying a product along a product conveying path in accordance with claim 133, wherein each pair of outer opposed rails are angled toward each other whereby trailing ends of each pair of outer opposed rails are closer than leading ends of each pair of outer opposed rails to align the product being propelled along the product conveying path at the trailing ends of each pair of outer opposed rails.

135. The method for conveying a product along a product conveying path in accordance with claim 76, wherein said moving step includes using a strap tensioning device which has said first and second straps wrapped therearound.

136. The method for conveying a product along a product conveying path in accordance with claim 76, further including providing ramps attached to said first and second straps.

137. The method for conveying a product along a product conveying path in accordance with claim 136, wherein said ramps are inclined plastic ramps.

138. The method for conveying a product along a product conveying path in accordance with claim 76, wherein said strap support device further including third and fourth straps for supporting the product being propelled along the product conveying path, said third and fourth straps being spaced from one another transversely across the conveying path between said first and second straps.

139. The method for conveying a product along a product conveying path in accordance with claim 138, wherein when said first and second straps are in the second position, said third and fourth straps support the product being propelled along the product conveying path.

140. The method for conveying a product along a product conveying path in accordance with claim 138, wherein said third and fourth straps are attached to a strap tensioning device for controlling tension therein.

141. The method for conveying a product along a product conveying path in accordance with claim 76, wherein said hold down support device is cantilevered over the product conveying path from one side thereof.

142. The method for conveying a product along a product conveying path in accordance with claim 141, wherein said hold down support device has a clamping mechanism which removeably attaches to a rail extending along one side of the product conveying path.

143. The method for conveying a product along a product conveying path in accordance with claim 76, wherein said hold down support device has a shaft with a slot therein into which said at least one strap is removably attached.

144. The method for conveying a product along a product conveying path in accordance with claim 143, further including the step of using a resilient clip to retain each at least one straps on said shaft.

145. The method for conveying a product along a product conveying path in accordance with claim 76, wherein said stop finger support device is cantilevered over the product conveying path from one side thereof.

146. The method for conveying a product along a product conveying path in accordance with claim 145, wherein said stop finger support device has a clamping mechanism which removeably attaches to a rail extending along one side of the product conveying path.

147. The method for conveying a product along a product conveying path in accordance with claim 76, wherein said stop finger support device rotates during said moving step to move said at least one stop finger attached thereto into the product conveying path to engaged the product at a leading end thereof following an indexing movement of the product and out of the product conveying path to begin an indexing movement of the product.

148. The method for conveying a product along a product conveying path in accordance with claim 76, wherein said moving step is performed by a piston-cylinder arrangement operationally connected to said stop finger support device.

* * * * *

UNITED STATES PATENT AND TRADEMARK OFFICE

CERTIFICATE OF CORRECTION

PATENT NO. : 6,629,690 B1
DATED : October 7, 2003
INVENTOR(S) : Wilfred S. Viens It is certified that error appears in the above-identified patent and that said Letters Patent is hereby corrected as shown below:

Column 2,
Line 11, "+ he" should be -- the --.

Column 3,
Line 61, after "of", "-" should be deleted.

Column 13,
Line 11, after "sheets", "." should be deleted.

Column 18,
Line 65, "29" should be -- 39 --.

Column 19,
Line 2, "29" should be -- 39 --.

Column 20,
Line 57, after "flat", "-" should be deleted.

Column 27,
Line 4, after "pusher", "-" should be deleted.
Line 23, after "in", "-" should be deleted.

Signed and Sealed this

Ninth Day of March, 2004

JON W. DUDAS
*Acting Director of the United States Patent and Trademark Office*